US011286674B2

(12) United States Patent
Loyd et al.

(10) Patent No.: US 11,286,674 B2
(45) Date of Patent: Mar. 29, 2022

(54) PANELIZED VENEER WALL COVERING SYSTEM AND METHOD

(71) Applicant: Stephen N. Loyd Irrevocable Family Trust, Dallas, TX (US)

(72) Inventors: Stephen N. Loyd, Garland, TX (US); William Ty May, Plano, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 0 days.

(21) Appl. No.: 16/746,404

(22) Filed: Jan. 17, 2020

(65) Prior Publication Data

US 2021/0222437 A1 Jul. 22, 2021

(51) Int. Cl.
*E04F 13/08* (2006.01)
*E04F 13/00* (2006.01)

(52) U.S. Cl.
CPC ..... *E04F 13/081* (2013.01); *E04F 13/0862* (2013.01); *E04F 13/0873* (2013.01)

(58) Field of Classification Search
CPC ..... E04B 2002/565; E04C 2/041; E04F 13/0803; E04F 13/0805; E04F 13/081; E04F 13/0814; E04F 13/0821; E04F 13/0823; E04F 13/0826; E04F 13/0862; E04F 13/0873
USPC ..... 52/314.555
See application file for complete search history.

(56) References Cited

U.S. PATENT DOCUMENTS 489,914 A * 1/1893 Ams ..... E04F 13/0862 52/388
658,868 A * 10/1900 Rosenbaum ..... E04F 13/0862 52/387
1,277,622 A 9/1918 Madison
1,840,244 A * 1/1932 Molnar ..... E04F 13/147 52/314
1,975,769 A * 10/1934 Cederholm ..... E04F 13/0841 52/387
2,043,706 A * 6/1936 Albert ..... E04F 13/0803 52/387

(Continued)

OTHER PUBLICATIONS

Benmark By Kingspan, "Section 07 42 63 Fabricated Wall Panel Assemblies", Feb. 8, 2019, 15 pages.

(Continued)

*Primary Examiner* — Brian D Mattei
*Assistant Examiner* — Joseph J. Sadlon
(74) *Attorney, Agent, or Firm* — Slater Matsil, LLP

(57) ABSTRACT

In certain embodiments, a system includes a support rail configured to attach to a wall and a veneer mounting plate configured to attach to the wall via the support rail. The mounting plate includes a first surface and an opposite second surface that faces the wall when the mounting plate is attached to the wall. The mounting plate includes a support shelf and a retention clip each extending from the first surface and spaced apart such that a channel is formed between them. A veneer object is attached to the mounting plate in the first channel by the retention clip and the support shelf. The retention clip and the support shelf are configured to contact first and second edges, respectively, of the veneer object. The veneer object is retained in position on the mounting plate at least in part by the retention clip and the support shelf.

21 Claims, 14 Drawing Sheets

(56) References Cited

U.S. PATENT DOCUMENTS 2,047,236 A * 7/1936 Thomas ..... E04B 1/7654 52/410
2,051,064 A * 8/1936 Worden ..... E04F 13/0801 52/416
2,063,135 A * 12/1936 Wallace ..... E04F 13/0803 52/774
2,198,466 A * 4/1940 Stolze ..... E04F 13/0801 52/385
2,278,822 A * 4/1942 Benz ..... E04F 13/0812 52/480
2,882,713 A * 4/1959 Diehl ..... E04F 13/0803 52/387
2,938,376 A * 5/1960 Workman ..... E04F 13/0862 52/426
3,005,293 A * 10/1961 Hunter ..... E04F 13/0805 52/385
3,290,846 A * 12/1966 Mader ..... E04F 13/0803 52/479
3,321,883 A 5/1967 Pascucci
3,533,206 A * 10/1970 Passeno, Jr. ..... E04F 13/08 52/387
4,238,915 A * 12/1980 Yoshida ..... E04F 13/0801 52/386
4,439,970 A * 4/1984 Rosner ..... E04F 13/0816 411/461
4,773,201 A 9/1988 Trezza
4,856,246 A * 8/1989 Shimasaki ..... E04F 13/0803 52/386
4,961,295 A * 10/1990 Kosch, Sr ..... A47F 5/0846 211/94.02
4,987,712 A * 1/1991 Mancuso ..... E04F 13/0862 52/387
5,122,019 A * 6/1992 Unger ..... E04F 13/0807 411/107
5,813,177 A * 9/1998 Wu ..... E04B 2/84 211/189
5,855,075 A * 1/1999 DiGiovanni ..... E04F 13/0862 33/518
6,098,364 A * 8/2000 Liu ..... E04F 13/0855 52/235
6,279,286 B1 * 8/2001 Ichihashi ..... E04F 13/0826 248/218.4
6,508,449 B2 * 1/2003 Veazey ..... A47F 5/0846 211/87.01
6,612,090 B1 * 9/2003 Corden ..... E04F 13/0803 52/235
6,691,472 B2 2/2004 Hubert
6,951,086 B2 * 10/2005 Passeno ..... E04F 13/0862 52/302.3
6,990,778 B2 * 1/2006 Passeno ..... E04F 13/0862 52/385
7,096,629 B1 * 8/2006 Cox ..... E04F 13/0814 52/235
8,141,310 B2 3/2012 Trezza
8,453,388 B2 * 6/2013 Neuhofer, Jr. ..... E04F 19/062 52/36.5
8,621,801 B2 * 1/2014 Bouchard ..... E04G 21/1883 52/314
8,806,826 B2 * 8/2014 Mann ..... E04F 13/0873 52/475.1
8,935,896 B2 * 1/2015 Tancredi ..... E04F 13/007 52/387
9,051,736 B2 * 6/2015 Geels ..... E04F 13/18
9,080,331 B2 * 7/2015 Aboukhalil ..... E04F 13/0816
9,163,413 B2 * 10/2015 Brady ..... E04C 2/043
9,267,280 B2 * 2/2016 Sawatzky ..... E04B 1/7038
9,512,621 B1 12/2016 Trezza
10,041,256 B2 * 8/2018 Scully ..... E04F 13/083
10,202,775 B2 * 2/2019 Krause ..... E04B 1/7629
10,316,524 B2 * 6/2019 Heidtmann ..... E04D 1/29
10,407,917 B1 * 9/2019 Bilge ..... E04F 13/0801
10,428,532 B2 * 10/2019 Smart ..... E04F 13/0894
10,550,577 B2 * 2/2020 Aboukhalil ..... E04F 13/0816
10,767,373 B2 * 9/2020 Aquilani ..... E04F 13/0807
11,021,868 B2 * 6/2021 Shin ..... E04F 13/0812
2007/0022682 A1 * 2/2007 Morgenegg ..... E04B 2/90 52/235
2011/0088337 A1 4/2011 Tancredi et al.
2012/0117904 A1 5/2012 Bouchard et al.
2014/0165486 A1 6/2014 Bouchard et al.
2015/0068149 A1 3/2015 Huff
2017/0037639 A1 2/2017 Taylor, Jr. et al.
2017/0130463 A1 * 5/2017 Taing ..... E04F 13/081
2019/0249443 A1 8/2019 Moghimi
2020/0018075 A1 * 1/2020 Sawada ..... E04B 1/40

OTHER PUBLICATIONS

Benchmark By Kingspan, "Thin Brick Facade, Facades Installation Guide", Oct. 2016, 24 pages.
Brick It, "CIS Exterior Wall System, CMU Backing", Detail 05.01.00, Jan. 12, 2019, 1 page.
Brick It, "CIS Exterior Wall, Steel Stud Backing", Detail 05.03.00-06.03.00, Nov. 12, 2018, 2 pages.
Brick It, "Designer Grid System Installation Instructions", www.brickit.com, downloaded Jan. 17, 2020, 2 pages, Hauppauge, New York.
Brick It, "DMG Interior Wall, Wood Stud Backing", Detail 01.02.00-02-02-00, Nov. 12, 2018, 2 pages.
Brick It, "Exterior Wall, Thickset, Wood Stud Backing", https://brickit.com/files/product_files/07.02.00.pdf, Detail 07-02-00-08.02.00, Nov. 12, 2018, 2 pages.
Brick It, "Home", https://brickit.com/, downloaded Jan. 17, 2020, 5 pages.
Brick It, "Interior Wall, Thinset, Wood Stud Backing", https://brickit.com/files/product_files/09.02.00.pdf, Detail 08.02.00-09.02.00, Nov. 12, 2018, 2 pages.
Brick It, "MCS Exterior Wall", Detail 03.01.00-03.03.00, Jan. 2019, 3 pages.
Brick It, "Systems", https://brickit.com/systems, downloanded Jan. 17, 2020, 30 pages.
Brick-It DMG et al., "Section 04215 Thin Brick Panel Systems", 6 pages.
Glen-Gery, "Interior Think Brick Brochure", https://www.glengery.com/sites/default/files/2019-10/GG_InteriorThinBrick_LRSpr.pdf, downloaded Jan. 17, 2020, 5 pages.
Glen-Gery, "Thin Brick Brochure", https://www.glengery.com/sites/default/files/2019-10/ThinBrick_16.pdf, downloaded Jan. 17, 2020, 16 pages.
Glen-Gery, "Thin Tech Brochure", https://www.glengery.com/sites/default/files/2019-10/ThinTechBrochure.pdf, downloaded Jan. 17, 2020, 4 pages.
Glen-Gery, "Thin Tech Classic", https://www.glengery.com/pro-resources?resource_types%5B754%5D=754, downloaded Jan. 17, 2020, 8 pages, Pottsbille Pike, Showmakersville, PA.
Glen-Gery, "Thin Tech Elite", https://www.glengery.com/pro-resources?resource_types%5B754%5D=754, downloaded Jan. 17, 2020, 13 pages, Pottsbille Pike, Showmakersville, PA.
Kingspan, "Facades-Brick", Detail #KPH-DS-01-BRH through KPH-TL-02-MTLH, Jan. 2019, 29 pages.
Old Mill Brick, LLC. "BrickPanel+ System Diagram, Exterior Application-Adhesive Option", https://www.oldmillbrick.com/pub/media/BrickPanel_System_Diagram_-_Adhesive_Option.pdf, downloaded Jan. 17, 2020, 1 page.
Old Mill Brick, LLC. "BrickPanel+System Diagram, Exterior Application-Adhesive on Cinderblock or Concrete", https://www.oldmillbrick.com/pub/media/BrickPanel_System_Diagram_-_Adhesive_without_Air_Barrier_on_Cinderblock.pdf, dowloaded Jan. 17, 2020, 1 page.
Old Mill Brick, LLC., "BrickPanel+ System Diagram, Exterior Application-Adhesive w/ Air Barrier on Cinderblock or Concrete", https://www.oldmillbrick.com/pub/media/BrickPanel_System_Diagram_-_Adhesive_w_Air_Barrier_on_Cinderblock.pdf, downloaded Jan. 17, 2020, 1 page.

(56) References Cited

OTHER PUBLICATIONS

Old Mill Brick, LLC., "BrickPanel + System Diagram, Exterior Application-Fastener Option", https://www.oldmillbrick.com/pub/media/BrickPanel_System_Diagram_-_Fastener_Option.pdf, downloaded Jan. 17, 2020, 1 page.
Old Mill Thin Brick Systems, "Installation Guide", https://www.oldmillbrick.com/pub/media/BrickPanel_Kit_-_Install_Guide.pdf, downloaded Jan. 17, 2020, 4 pages.
Old Mill Brick, Inc., "Products", https://www.oldmillbrick.com/pub/media/Products_information_sheet.pdf, downloaded Jan. 17, 2020, 1 page.
TABS, "TABS II PLUS "Rain Screen Wrap"", http://www.tabswallsystems.com/wp-content/uploads/2017/09/Tabs_II_Plus_flyer_final.pdf, downloaded Jan. 17, 2020, 2 pages, Grand Rapids, MI.
TABS II, "Product Information TABS Wall Systems", http://www.tabswallsystems.com/wp-content/uploads/2017/09/Product_Info81.pdf, downloaded Jan. 17, 2020, 2 pages, Grand Rapids, MI.
TABS II, "The Structural Support Panel System for Thin Brick, Tile or Stone." http://www.tabswallsystems.com/wp-content/uploads/2017/09/TABS-Brochure1.pdf, downloaded Jan. 17, 2020, 4 pages, Grand Rapids, MI.
TABS, "TABS II Wall Systems for Residential Architecture", http://www.tabswallsystems.com/wp-content/uploads/2017/09/Residential.pdf, downloaded Jan. 17, 2020, 2 pages, Grand Rapids, MI.
TABS, "TABS IP for Light Duty Applications", http://www.tabswallsystems.com/wp-content/uploads/2017/09/Tabs_IP_flyer_final.pdf, downloaded Jan. 17, 2020, 2 pages, Grand Rapids, MI.
TABS, "TABS Stone System Designer Thin Stone",http://www.tabswallsystems.com/wp-content/uploads/2017/09/Stone-Brochure-1.pdf, downloaded Jan. 17, 2020, 4 pages, Grand Rapids, MI.
TABS, "TABS TI Offers Owners & Architects an Exterior Veneer Finish System Insulated up to R-10", http://www.tabswallsystems.com/wp-content/uploads/2017/09/Tabs_TI_flyer_final.pdf, downloaded Jan. 17, 2020, 2 pages, Grand Rapids, MI.

* cited by examiner

FIG. 2B
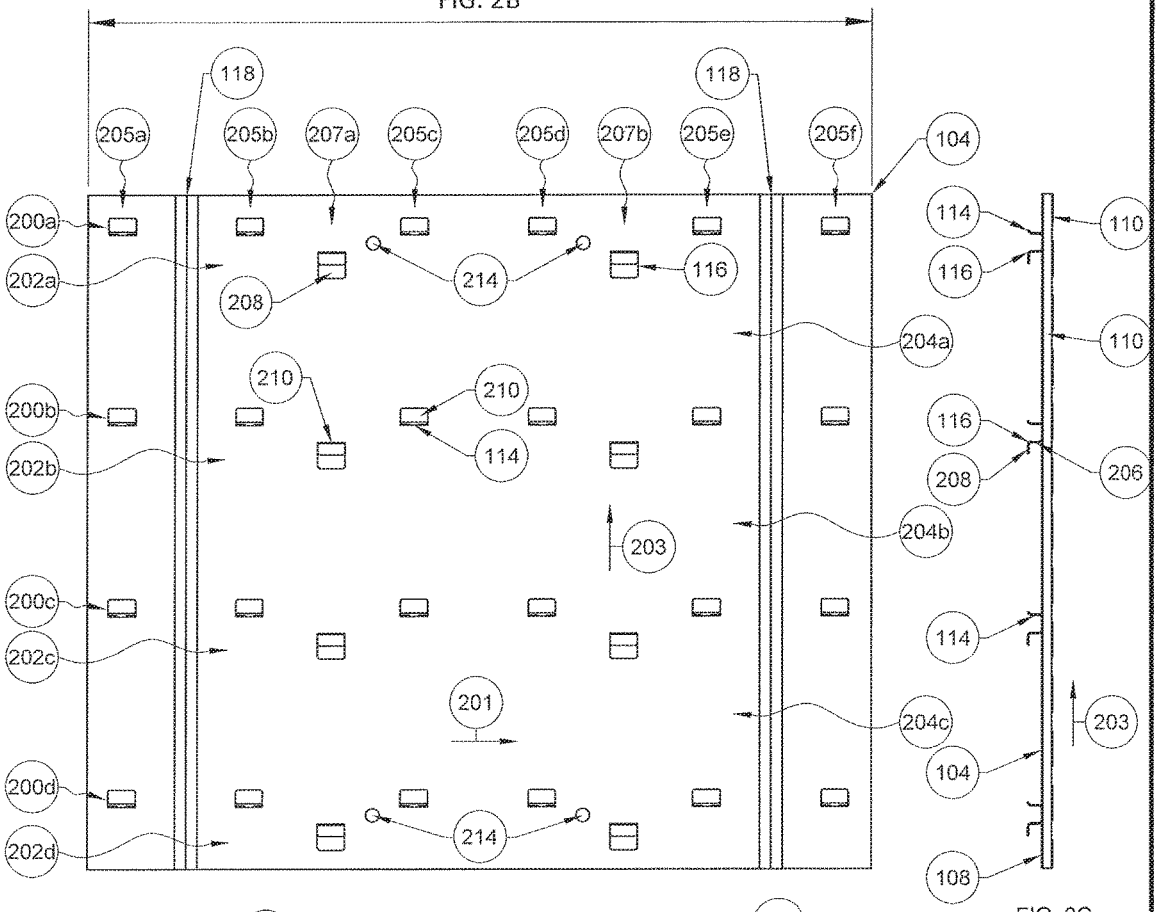
FIG. 2C
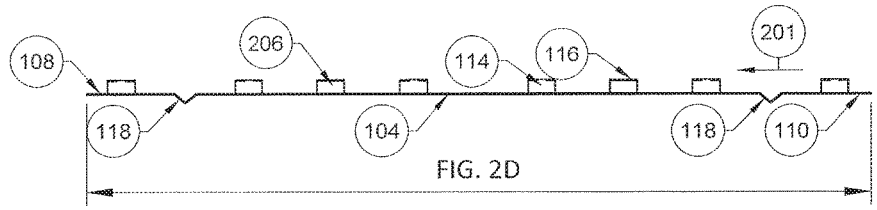
FIG. 2D

PANELIZED VENEER WALL COVERING SYSTEM AND METHOD

TECHNICAL FIELD

This disclosure relates generally to construction, and more particularly to a panelized veneer wall covering system and method.

BACKGROUND

Structures, such as buildings and homes, include one or more walls. These walls may be interior and/or exterior walls. In certain instances, it may be desirable to install a covering on the wall. The covering may serve a variety of purposes. For example, the covering may enhance or otherwise alter the appearance of the wall. As another example, the covering may protect the wall from damage, such as weather-related damage. As another example, the covering may provide a layer of insulation for the structure. As another example, the covering may provide a combination of these and other advantages. Various types of objects, such as those formed from brick, ceramic, stone, glass, or other suitable materials, may be used to provide the covering. Examples of such objects are so-called "thin bricks," which may be used in certain applications.

SUMMARY

In certain embodiments, a system includes a support rail, a veneer mounting plate, and a veneer object. The support rail is configured to attach to a wall. The veneer mounting plate is configured to attach to the wall via the support rail. The veneer mounting plate includes a first surface and a second surface opposite the first surface and adapted to face the wall when the veneer mounting plate is attached to the wall via the support rail. The veneer mounting plate further includes a first support shelf extending from the first surface and a first retention clip extending from the first surface. The first support shelf and the first retention clip are spaced apart in a first direction such that a first channel is formed between the first retention clip and the first support shelf. The veneer object is attached to the veneer mounting plate in the first channel by the first retention clip and the first support shelf, and has a first edge and a second edge opposite the first edge. The first retention clip is configured to contact the first edge and support shelf is configured to contact the second edge. The veneer object is retained in position on the veneer mounting plate at least in part by the first retention clip and the first support shelf.

In certain embodiments, a method includes attaching, to form a preassembled veneer panel, a number of veneer objects to a first surface of a veneer mounting plate using respective mechanical attachment mechanisms. Each mechanical attachment mechanism includes a support shelf and a retention clip. The method further includes attaching, via a first panel attachment element on a second surface of the veneer mounting plate, the preassembled veneer panel to a first support rail coupled to a wall. The second surface of the veneer mounting plate is opposite the first surface and is adapted to face the wall when the veneer mounting plate is attached to the wall via the first support rail.

In certain embodiments, a system includes first and second panel attachment elements configured to attach to a wall via respective support rails attached to the wall. The system further includes a veneer mounting plate configured to attach to the wall via the first and second panel attachment elements. The veneer mounting plate includes a first surface and a second surface opposite the first surface and adapted to face the wall when the veneer mounting plate is attached to the wall. The first and second panel attachment elements each include a respective retaining base for attaching to the second surface of the veneer mounting plate and a respective channel for attaching to the respective support rails. The veneer mounting plate further includes support shelves extending from the first surface, the support shelves being arranged in rows that each include multiple support shelves. The veneer mounting plate further includes retention clips extending from the first surface, the retention clips being arranged in rows that each include multiple retention clips. The rows of support shelves and the rows of retention clips are spaced apart and alternating such that respective channels are formed between a row of retention clips and an adjacent row of support shelves. A retention clip in a first row of retention clips and a support shelf in the adjacent row of support shelves is configured to attach a veneer object to the veneer mounting plate in the channel between the first row of retention clips and the adjacent row of support shelves.

Particular embodiments of this disclosure may provide one or more technical advantages. For example, in certain embodiments, mechanical attachment mechanisms (e.g., one or more support shelves and one or more retention clips) of a veneer mounting plate retain veneer objects (e.g., thin bricks) in position on the veneer mounting plate via a mechanical attachment.

In certain embodiments, the veneer mounting plate allows for the formation of preassembled veneer panels to which multiple veneer objects have been attached prior to attachment of the veneer panel to a wall of a structure. For example, prior to attachment of a veneer mounting plate to a wall of a structure, a first surface of a veneer mounting plate (what will be the "front" surface of the veneer mounting plate when the veneer mounting plate is attached to a wall of a structure) may be covered with a desired number of veneer objects that have been attached to the veneer mounting plate using mechanical attachment mechanisms of the veneer mounting plate. It may be possible to preassemble these veneer panels at a first location (e.g., a production facility) and ship the preassembled veneer panels to a second location (e.g., a construction site) to be attached to a wall of a structure.

This preassembly capability may allow a large number of veneer objects (e.g., thin bricks) to be assembled into a finished veneer panel at a production facility, with the veneer objects pre-installed and properly coursed and the veneer panel ready to attach to a wall of a structure (e.g., using a panel attachment system). The veneer panel may be self-supporting to allow for easy handling and shipping (including long-distance shipping) to projects anywhere in the world. This preassembly capability may reduce or eliminate in-the-field assembly of the veneer panel, which can lead to inconsistent results and slow the installation process.

In certain embodiments, due at least in part to the mechanical nature of the attachment of veneer objects to the veneer mounting plate and/or the preassembly of veneer panels, it may be possible/permissible (e.g., via appropriate regulations) to attach veneer panels to a wall of a structure at greater heights than would be possible with previous and existing systems. As just one specific example, it may be possible to attach veneer panels to a wall of a structure at heights exceeding four hundred feet.

Some types of veneer objects (e.g., thin bricks) may be available in standard sizes. In certain embodiments, the mechanical attachment mechanism of the veneer mounting plate (e.g., the support shelves and retention clips of the veneer mounting plate) are designed to fit with standard-sized veneer objects (e.g., standard-sized thin bricks) without requiring specialized shaped and sized veneer objects. Thus, certain embodiments of this disclosure do not require specially-designed veneer objects (e.g., thin bricks) that are specific to the system.

In certain embodiments, the veneer mounting plate, including potentially the mechanical attachment mechanism (e.g., support shelves and retention clips), is made of stainless steel or another durable material, which may provide for a long life and unique properties that the material (e.g., stainless steel) lends to the mechanical attachment process.

In certain embodiments, the veneer mounting plate is designed to fit with a panel attachment system (for attachment to a wall of a structure), which may provide for an easy and flexible installation process. In certain embodiments, the mechanical attachment feature coupled with the veneer panels being attachable to a wall using a panel attachment system, provides a mechanically-attached ventilated backdrop rainscreen cladding system. Additionally or alternatively, in certain embodiments, the mechanical attachment feature coupled with being part of an engineered system allows veneer panels to be attached at heights greater than previous and existing systems.

In certain embodiments, even after attachment of a veneer panel to a panel attachment system (attached to a wall of a structure), veneer panels may still be adjusted independently (e.g., using an adjustment mechanism) for proper alignment on the wall of the structure.

Certain embodiments of this disclosure may provide some, all, or none of these advantages. Certain embodiments may provide one or more other technical advantages, one or more of which may be readily apparent to those skilled in the art from the figures, descriptions, and claims.

BRIEF DESCRIPTION OF THE DRAWINGS

To provide a more complete understanding of embodiments of this disclosure and the features and advantages thereof, reference is made to the following description taken in conjunction with the accompanying drawings, in which:

FIGS. 2A-2D illustrate various views of veneer mounting plate, according to certain embodiments of this disclosure.

DETAILED DESCRIPTION OF ILLUSTRATIVE EMBODIMENTS

Figure 1A:
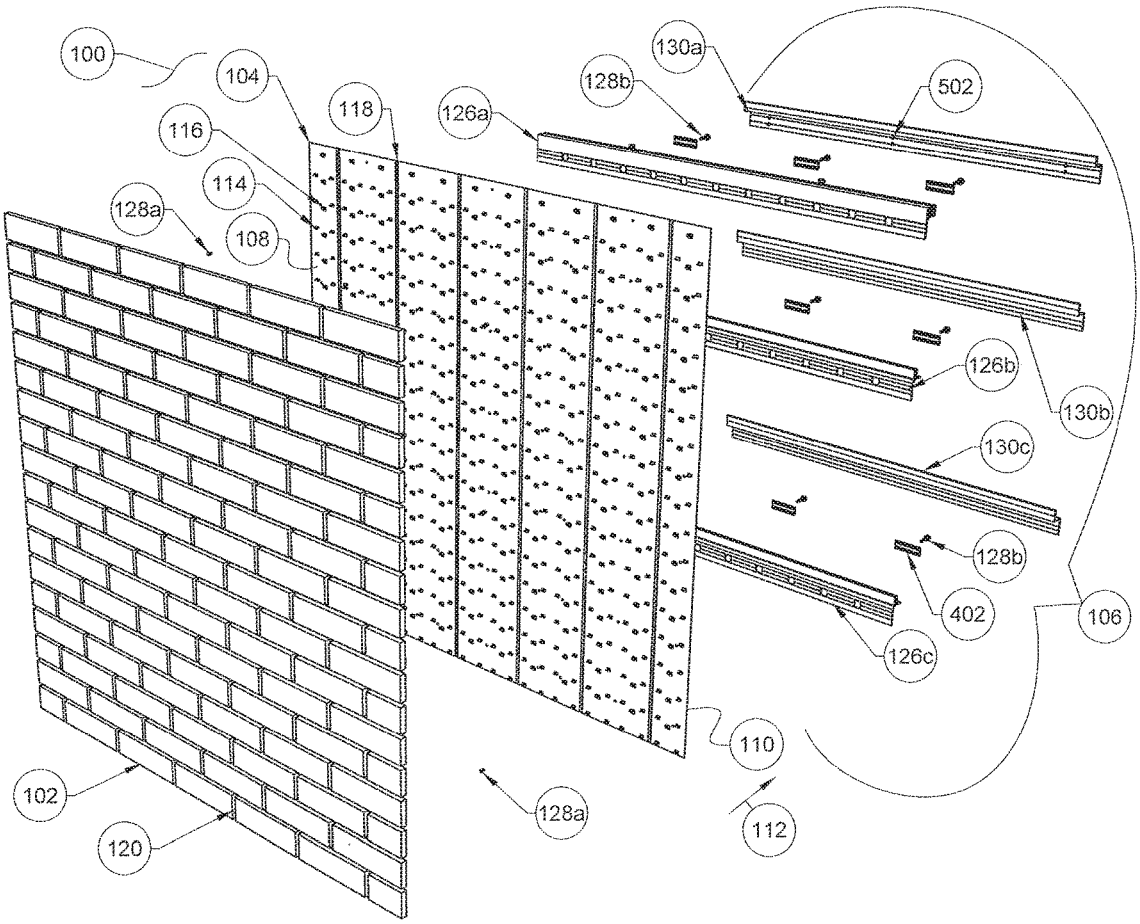
FIGS. 1A-1C illustrate an example of a panelized veneer wall covering system, according to certain embodiments of this disclosure.
Figure 1B:
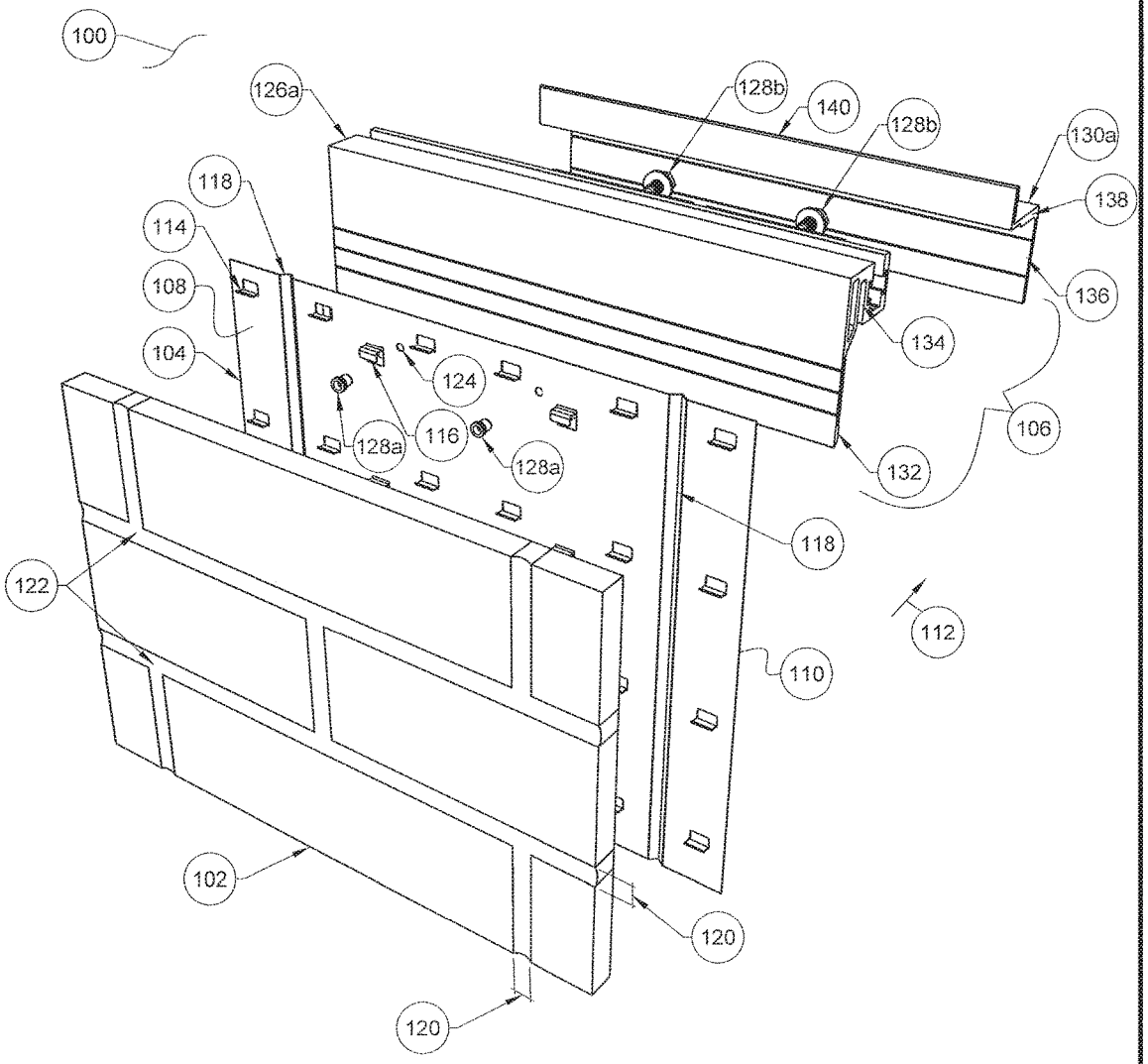
Figure 1C:
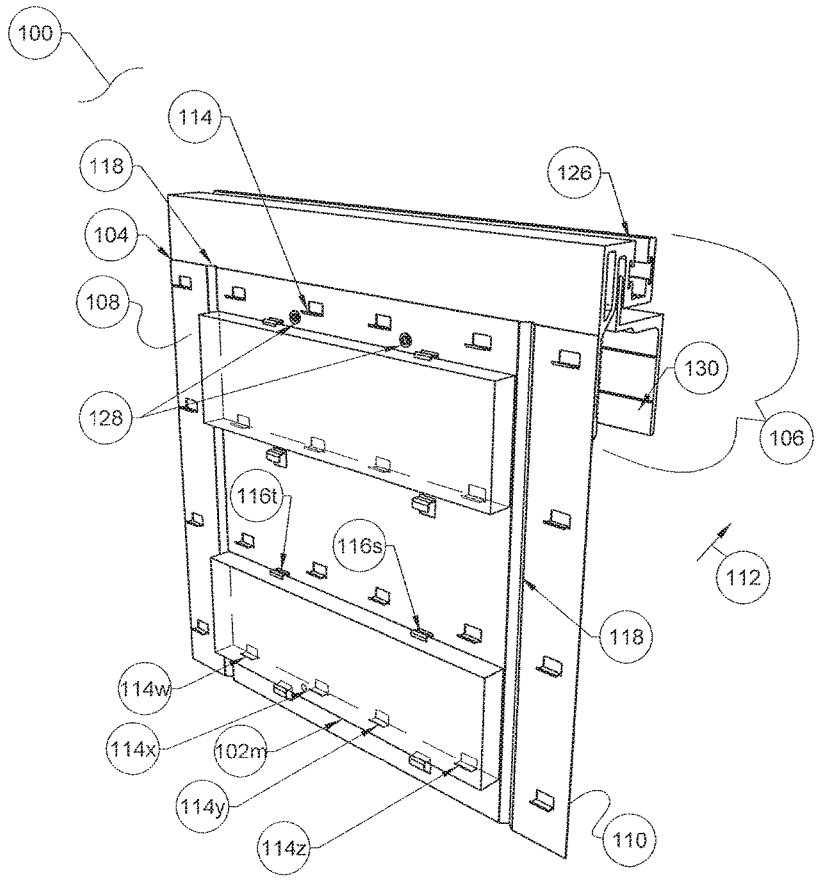

FIGS. 1A-1C illustrate an example of a panelized veneer wall covering system 100, according to certain embodiments of this disclosure. In this illustrated example, system 100 includes veneer objects 102, veneer mounting plate 104, and panel mounting system 106. FIG. 1A illustrates what might be considered a single panel for installation on a wall of a structure. In certain embodiments, multiple panels might be used to cover a larger portion (or the entirety) of a wall of a structure. FIGS. 1B and 1C illustrate magnified views of a portion of system 100. In particular, FIG. 1B illustrates an exploded magnified view of a portion of system 100, and FIG. 1C illustrates an assembled magnified view of system 100, both according to certain embodiments of this disclosure.

Veneer objects 102 may include any suitable type of covering, including, for example, bricks, thin bricks, panels, tiles, blocks, or any other suitable objects that may serve as a covering for a wall. Furthermore, veneer objects 102 may be made of any suitable type of material or combination of materials, including, for example, stone, clay, glass, ceramic, aluminum, wood, composite graphite, or any other suitable material or combination of materials. Additionally, the types and materials of veneer objects 102 may be mixed within a particular installation, if desired. Veneer objects 102 may have any suitable dimensions, according to particular implementations. Furthermore, the dimensions of veneer objects 102 may vary, as desired. In certain embodiments, veneer objects 102 are so-called "thin bricks," which resemble traditional bricks but are thinner than traditional bricks.

Veneer mounting plate 104 provides a support interface for attaching veneer objects 102 to a wall of a structure. Veneer objects 102 are attached to veneer mounting plate 104 to create veneer panels. Veneer mounting plate 104 has a first surface 108 and a second surface 110, which is opposite to first surface 108. Second surface 110 faces the wall of the structure, which is located in the direction shown by arrow 112, when the veneer mounting plate 104 is installed on the wall of the structure. In this way, first surface 108 might be considered the front, outward-facing surface of veneer mounting plate 104, which second surface 110 might be considered the back, rearward-facing surface of veneer mounting plate 104.

Veneer mounting plate 104 includes mechanical attachment mechanisms on first surface 108 for attaching veneer objects 102 to veneer mounting plate 104. Veneer objects 102 are attached to veneer mounting plate 104 using the mechanical attachment mechanisms, and the mechanical attachment mechanisms mechanically retain veneer objects 102 in position on veneer mounting plate 104. This disclosure contemplates mechanical attachment mechanisms of veneer mounting plate 104 being implemented in any suitable manner to mechanically retain veneer objects 102 in position on veneer mounting plate 104.

In certain embodiments, the mechanical attachment mechanisms of veneer mounting plate 104 include one or more support shelves 114 and one or more retention clips 116 extending from first surface 108 of veneer mounting plate 104. A particular mechanical attachment mechanism may include one or more support shelves 114 and one or more retention clips 116. In such embodiments, veneer objects 102 attached to veneer mounting plate 104 using one or more support shelves 114 and one or more retention clips 116, and the one or more support shelves 114 and the one or more retention clips 116 cooperate to retain the veneer object 102 in position on veneer mounting plate 104. In certain embodiments, support shelves 114 are configured to support the dead weight of one or more veneer objects 102 and retention clips 116, through a resilient property, are configured to apply a holding force against a veneer object 102 (in the direction of the one or more support shelves 114 for the veneer object 102) to retain the veneer object 102 in position on veneer mounting plate 104.

Taking a particular veneer object 102*m* as an example (see, e.g., FIG. 1C), veneer object 102*m* is attached to veneer mounting plate 104 using four support shelves 114 (support shelves 114*w*, 114*x*, 114*y*, and 114*z*) and two retention clips 116 (retention clips 116*s* and 116*t*). Although a particular number of support shelves 114 and retention clips 116 are described in this example, this disclosure contemplates veneer objects 102 being supported by any suitable number of support shelves 114 and retention clips 116, according to particular implementations.

Support shelves 114 and retention clips 116 may be arranged on first surface 108 of veneer mounting plate 104 in any suitable locations to achiever particular arrangements of veneer objects 102. This disclosure describes a particular example arrangement in which support shelves 114 and retention clips 116 are arranged in alternating rows, creating corresponding channels for insertion of veneer objects 102, but it should be understood that this disclosure contemplates any suitable arrangement, according to particular needs. This disclosure describes additional details of the example arrangement of support shelves 114 and retention clips 116 on first surface 108 of veneer mounting plate 104 with respect to FIGS. 2A-2D.

Continuing with the description of FIGS. 1A-1C, in certain embodiments, veneer objects 102 attached to veneer mounting plate 104 are separated from adjacent veneer objects 102 attached to veneer mounting plate 104 by respective gaps 120. A filler material 122 may be deposited in gaps 120. This disclosure contemplates any suitable filler material 122. Particular example materials for filler material 122 include any suitable combination of elastomeric mortar, grout, or any other suitable filler material. Filler material 122 may serve one or more purposes. For example, filler material 122 may enhance the appearance of the veneer panel. As another example, filler material 122 may act as a sealant. As another example, filler material 122 may contribute to retaining veneer objects 102 in position on veneer mounting plate 104.

Although mechanical attachment mechanisms are described as retaining veneer objects 102 in position on veneer mounting plate 104, this disclosure also contemplates, in certain embodiments, one or more other elements (e.g., an adhesive substance applied between the veneer object 102 and veneer mounting plate 104) being used in combination with mechanical attachment mechanisms to retain veneer objects 102 in position on veneer mounting plate 104. Thus, it should be understood that this disclosure contemplates embodiments in which mechanical attachment mechanisms alone retain veneer objects 102 in position on veneer mounting plate 104, as well as embodiments in which mechanical attachments in connection with one or more other elements (e.g., an adhesive) to retain veneer objects 102 in position on veneer mounting plate 104.

Veneer mounting plate 104 may include one or more stiffening ribs 118. In certain embodiments, stiffening ribs 118 extend along a significant dimension (and potentially the entire dimension, as illustrated) of veneer mounting plate 104. Stiffening ribs 118 generally help to stabilize or otherwise increase the rigidity of veneer mounting plate 104. For example, stiffening ribs 118 may reduce or eliminate bending of veneer mounting plate 104 (e.g., from top to bottom). Although shown as extending from top to bottom, to the extent stiffening ribs 118 included on veneer mounting plate 104, this disclosure contemplates stiffening ribs 118 extending from top to bottom, from side to side, or along any other suitable dimension of veneer mounting plate 104, alone or in combination.

In certain embodiments, veneer mounting plate 104 includes one or more apertures 124, which may be used to attach one or more components of panel mounting system 106 to veneer mounting plate 104. Veneer mounting plate 104 may include any suitable number of apertures 124 for attachment of one or more components of panel mounting system 106, as may be appropriate for particular implementations. Attachment of one or more components of panel mounting system is described in greater detail below.

Veneer mounting plate 104 may be made of any suitable material. In certain embodiments, veneer mounting plate 104 is made of stainless steel. Veneer mounting plate 104 may have any suitable dimensions, according to particular implementations. As just one particular example, veneer mounting plate 104 may be four feet by four feet.

Panel mounting system 106 is configured to attach veneer mounting plate 104 to a wall of a structure. In the illustrated example, panel mounting system 106 includes one or more panel attachment elements 126 (including, in the illustrated example of FIG. 1A, panel attachment elements 126*a*-126*c*), one or more fasteners 128, and one or more support rails 130 (including, in the illustrated example of FIG. 1A, support rails 130*a*-130*c*. In general, panel attachment elements 126*a*-126*c* attach to veneer mounting plate 104 and are configured to attach to a corresponding support rail 130*a*-130*c*, respectively, attached to a wall of a structure.

Panel attachment elements 126*a*-126*c* attach to second surface 110 of veneer mounting plate 104 using one or more fasteners 128 inserted through corresponding apertures 124 in veneer mounting plate 104. In one example, fasteners 128 are bolt/nut combinations (with fasteners 128 shown in FIGS. 1A and 1B as combinations of nuts 128*a* and bolts 128*b* and in FIG. 1C as fasteners 128). This disclosure, however, contemplates using other types of fasteners, if appropriate. Although panel attachment elements 126*a*-126*c* are described as components that are separate from but attached to veneer mounting plate 104, this disclosure contemplates one or more of panel attachment elements 126*a*-126*c* being integrally formed with veneer mounting plate 104 (e.g., as L-shaped elements extending from second surface 110 of veneer mounting plate).

In the illustrated example, panel attachment elements 126*a*-126*c* include respective retaining bases 132 and channels 134. Panel attachment elements 126*a*-126*c* are positioned such that the respective retaining bases 132 rest against second surface 110 of veneer mounting plate 104, and apertures in retaining bases 132 are aligned with corresponding apertures 124 in veneer mounting plate 104 such that fasteners 128 can be inserted and used to secure panel attachment elements 126*a*-126*c* to veneer mounting plate 104. Additional views and associated features of example panel attachment elements 126 and the attachment of panel attachment elements 126 to veneer mounting plate 104 are shown in and described below with reference to FIGS. 4-6.

Support rails 130*a*-130*c* are configured to be attached to a wall (e.g., using one or more fasteners, such as one or more screws). Support rails 130*a*-130*c* may be spaced at suitable intervals for engagement of panel attachment elements 126*a*-126*c*. In the example illustrated in FIG. 1A, veneer mounting plate 104 is configured for attaching three panel attachment elements 126*a*-126*c*, which are configured to attach to three corresponding support rails 130*a*-130*c*. Although system 100 is described as including a particular number of panel attachment elements 126 and support rails 130, this disclosure contemplates any suitable number of panel attachment elements 126 and support rails 130 being used to attach veneer mounting plates 104 to a wall of a structure. Furthermore, this disclosure contemplates using any suitable technique (including those other than panel mounting system 106) to attach veneer mounting plates 104 to a wall of a structure.

In the illustrated example, support rails 130*a*-130*c* include respective support rail bases 136, support arms 138, and protrusions 140. Each support rail base 136 is adapted to be placed against a wall of a structure (with any suitable intervening elements, such as one or more shims, if appropriate). Support rails 130*a*-130*c* are configured to couple to a wall of a structure using one or more fasteners inserted through apertures in the retaining base 136 of the support rail 130 (as described in greater detail below with reference to FIG. 6).

Each support arm 138 extends from a respective support rail base 136 of a respective support rail 130 in a direction away (e.g., perpendicularly) from the wall of the structure and provides a spacing from the wall of the structure. A protrusion 140 extents from each support arm 138 and is configured to engage with respective channels 134 of a corresponding channel attachment element 126 to attach a veneer mounting plate 104 to a wall of a structure.

Although support rails 130*a*-130*c* are shown as having a same general length as the width of veneer mounting plate 104, this disclosure contemplates support rails 130*a*-130*c* being longer or shorter, according to particular implementations. For example, support rails 130*a*-130*c* may be long enough to support the mounting of multiple veneer mounting plates 104 laterally adjacent to one another.

In certain embodiments, when a veneer panel is coupled to a wall of a structure using panel mounting system 106, panel attachment elements 126 cooperate with corresponding support rails 130 to provide one or more types of support for the veneer panel. As just one example, in some implementations when a veneer panel is attached to a wall of a structure using panel mounting system 106, panel attachment element 126*a* (in cooperation with a corresponding support rail 130*a*) is configured to support a dead load of the veneer panel to which it is attached and other panel attachment elements 126, such as panel attachment elements 126*b* and 126*c* (in cooperation with a corresponding support rails 130*b* and 130*c*), are configured to provide lateral support for the veneer panel. Of course, this disclosure contemplates panel attachment elements 126 (and corresponding support rails 130) providing any suitable type of support, alone or in combination, as may be appropriate for particular implementations.

In certain embodiments, system 100 allows one or more veneer objects 102 to be attached to veneer mounting plate 104 prior to attachment of veneer mounting plate 104 to a wall of a structure (e.g., via panel attachment system 106 or in another suitable way). For example, the desired number of veneer objects 102 in a desired arrangement may be attached to veneer mounting plate 104 to form preassembled veneer panels prior to attachment of veneer mounting plate 104 to a wall of a structure. In some cases, these preassembled veneer panels may be assembled at a first site (e.g., a production facility) and shipped to a second site (e.g., an installation site at which the structure having the wall is located) for installation of the preassembled veneer panel.

It should be understood that this disclosure contemplates attaching veneer mounting plate 104 on a wall of a structure (e.g., using panel attachment system 106 or another suitable attachment mechanism) prior to attaching veneer elements 102 to veneer mounting plate 104, if desired.

For purposes of this disclosure, a veneer panel may refer to the combination of a veneer mounting plate 104 with one or more veneer objects 102 attached to the veneer mounting plate 104. In some cases, the veneer panel further includes filler material 122, one or more fasteners 128, and/or one or more panel attachment elements 126*a*-126*c* in any suitable combination. For purposes of this disclosure, a preassembled veneer panel refers to a veneer panel that is assembled prior to attachment of the veneer panel to a wall of a structure (e.g., via panel attachment system 106 or in another suitable way).

To the extent veneer objects 102 are attached to veneer mounting plate 104 prior to attachment of panel attachment elements 126*a*-126*c* to veneer mounting plate 104, when positioning veneer objects 102 on veneer mounting plate 104, it may be appropriate to leave enough apertures 124 exposed (e.g., in gaps 120 between adjacent veneer objects 102) to allow fasteners 128 to be inserted through apertures 124 for attachment of panel attachment elements 126*a*-126*c* to second surface 110 of veneer mounting plate 104. Additionally or alternatively, panel attachment elements 126*a*-126*c* may be attached to second surface 110 of veneer mounting plate 104 (or at least fasteners 128 may be inserted through apertures 124) prior to attachment of veneer objects 102 to first surface 108 of veneer mounting plate 104, in which case apertures 124 may be positioned behind veneer objects 102, if desired.

In certain embodiments, veneer mounting plate 104 (e.g., in this case a veneer panel) would be one of multiple veneer mounting plates 104 on a wall of a structure, likely in multiple rows and columns, to cover a significant portion, or all of, the wall. Thus, it will be appreciated that FIG. 1 illustrates what might be considered one veneer panel of veneer objects 102 (or a portion of one veneer panel of veneer objects 102) that is installed or to be installed on a wall of a structure.

Figure 2A:
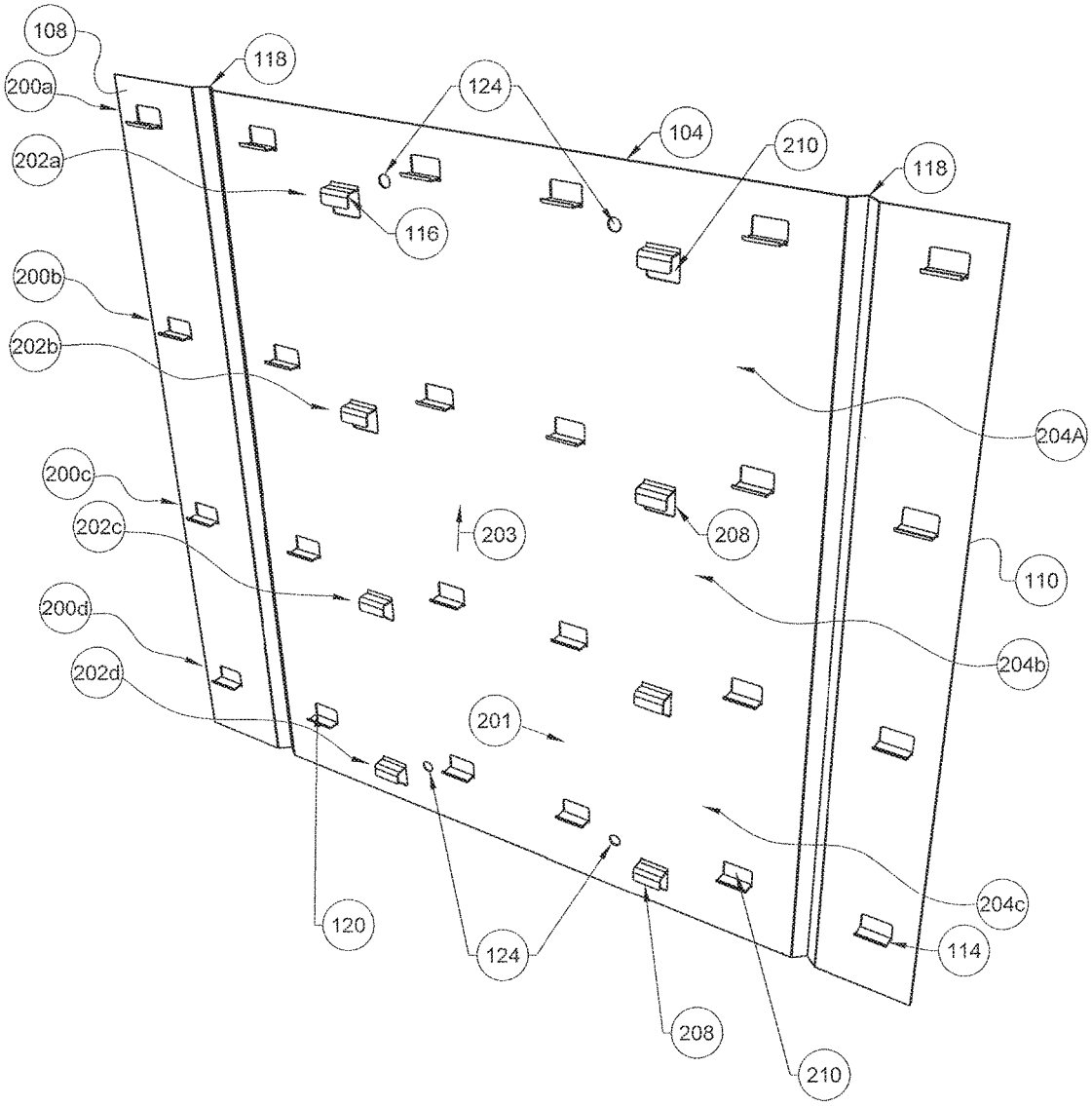

FIGS. 2A-2D illustrate various views of veneer mounting plate 104, according to certain embodiments of this disclosure. In particular, FIG. 2A illustrates an angled view of a first surface 108 of veneer mounting plate 104, FIG. 2B illustrates a direct centered view of the first surface 108 of veneer mounting plate 104, FIG. 2C illustrates a side view of veneer mounting plate 104, and FIG. 2D illustrates a top view of veneer mounting plate 104, according to certain embodiments of this disclosure.

In the illustrated example of FIGS. 2A-2D, veneer mounting plate 104 includes support shelves 114 and retention clips 116 extending from first surface 108 of veneer mounting plate 104. Support shelves 114 and retention clips 116, in this example, are arranged in alternating, spaced apart rows 200 and 202, respectively. For example, veneer mounting plate 104 includes rows 200*a*, 200*b*, 200*c*, and 200*d* of support shelves 114, with each row 200 including multiple laterally-spaced, in a direction 201, support shelves 114. As another example, veneer mounting plate 104 includes rows 202*a*, 202*b*, 202*c*, and 202*d* of retention clips 116, with each row 202 including multiple laterally-spaced, in direction 201, retention clips 116.

Rows 200 of support shelves 114 are spaced apart from rows 202 of retention clips 116 in a direction 203 such that a channel 204 is formed between a row 200 of support shelves 114 and a row 202 of retention clips 116. For example, row 202*a* of retention clips 116 is spaced apart from row 200*b* of support shelves 114, forming channel 204*a* between row 202*a* and row 200*b*. As another example, row 202*b* of retention clips 116 is spaced apart from row 200*c* of support shelves 114, forming channel 204*b* between row 202*b* and row 200*c*. As another example, row 202*c* of retention clips 116 is spaced apart from row 200*d* of support shelves 114, forming channel 204*c* between row 202*c* and row 200*d*. Thus, in certain embodiments, veneer mounting plate 104 includes multiple parallel channels 204. When attached to veneer mounting plate 104, veneer objects 102 are positioned in channels 204 between at least one retention clip 116 and at least one support shelf 114.

In the illustrated example, support shelves 114 and retention clips 116 are arranged in spaced apart columns 205 and 207, respectively. For example, veneer mounting plate 104 includes columns 205*a*, 205*b*, 205*c*, 205*d*, 205*e*, and 205*f* of support shelves 114, with each column 205 including multiple spaced-apart, in a direction 203, support shelves 114. As another example, veneer mounting plate 104 includes columns 207*a* and 207*b* of retention clips 116, with each column 207 including multiple spaced-apart, in direction 203, retention clips 116.

In the illustrated arrangement, support shelves 114 and retention clips 116 are offset laterally, in direction 201, such that columns 205 of support shelves 114 are offset laterally from columns 207 of retention clips 116. This disclosure is not limited to such an arrangement.

In the illustrated arrangement, and depending on the size of veneer objects 102, it may be appropriate in certain embodiments for a veneer object 102 to be attached to veneer mounting plate 104 such that the veneer object 102 is in the channel 204 between and contacts at least one retention clip 116 and at least two support shelves 114; however, this disclosure is not limited to such an arrangement.

Although support shelves 114 and retention clips 116 are shown as having particular dimensions, this disclosure contemplates support shelves 114 and retention clips 116 having different dimensions. For example, support shelves 114 and/or retention clips 116 may extend further from first surface 108 of veneer mounting plate 104 as may be appropriate to accommodate the dimensions of the veneer objects 102 to be attached to veneer mounting plate 104. As another example, support shelves 114 and/or retention clips 116 may extend further along a lateral dimension of veneer mounting plate 104, which may reduce the number of support shelves 114 and/or retention clips 116 per row 200 and/or 202, respectively.

In the illustrated example, the support shelves 114 of a row 200 (e.g., row 200*b*) extend from first surface 108 of veneer mounting plate 104 at a slight angle toward a corresponding row 202 (e.g., row 202*a*) of retention clips 116 across the channel 204 (e.g., 204*a*) in which veneer objects 102 will be attached to veneer mounting plate 104 using those support shelves 114 and retention clips 116; however, this disclosure contemplates support shelves being perpendicular or at other suitable angles.

Figure 3:
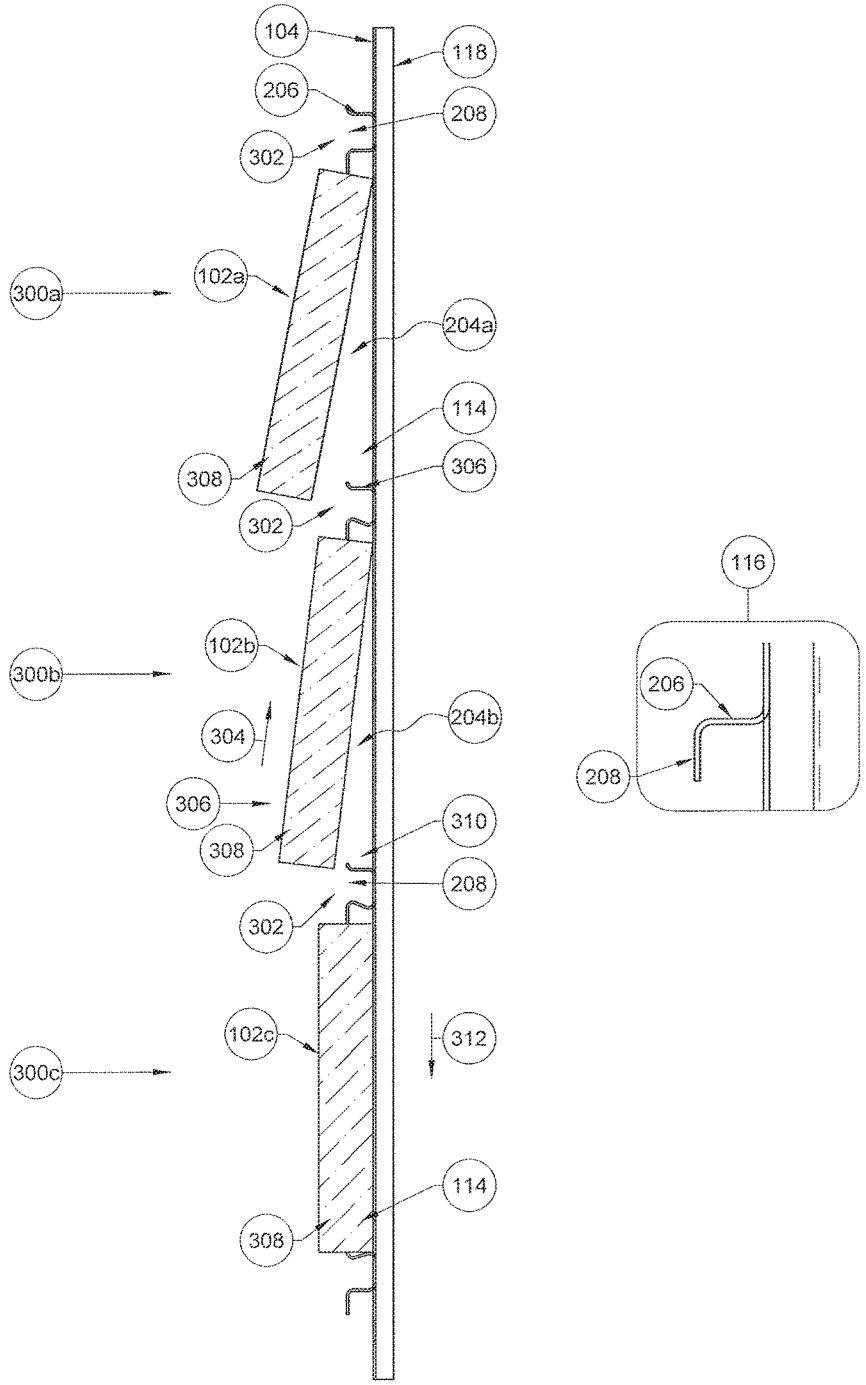
FIG. 3 illustrates a side view of an example process for attaching a veneer object to a veneer mounting plate, according to certain embodiments of this disclosure.
Figure 4:
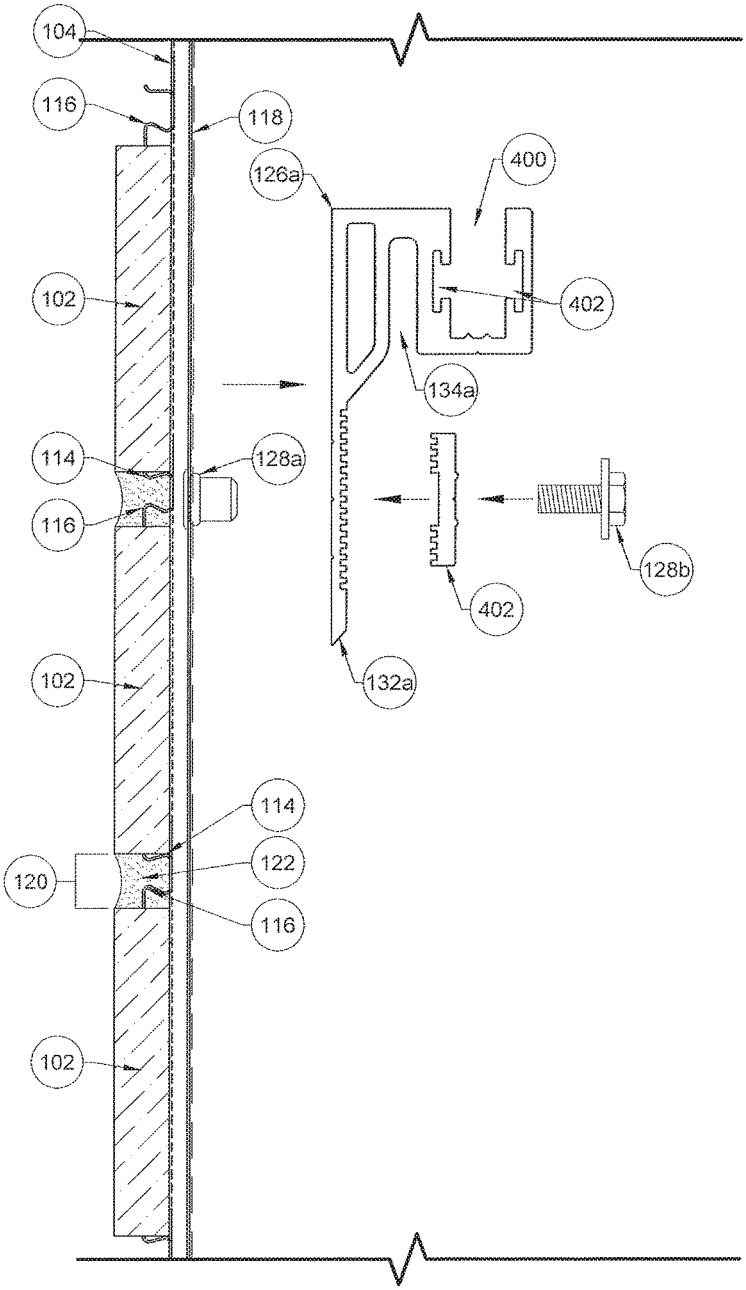
FIG. 4 illustrates a side view of attachment of a panel attachment element to a veneer mounting plate, according to certain embodiments of this disclosure.

In the illustrated example, each retention clip 116 is generally L-shaped and includes a resilient arm 206 and a stabilizing arm 208. FIGS. 3 and 4, described in greater detail below, also illustrate example details of retention clip 116. Resilient arm 206 is sufficiently flexible to accommodate attachment of a veneer object 102 to veneer mounting plate 104, but sufficiently resilient to apply a holding force against a surface of the veneer object 102 (via stabilizing arm 208) in the direction of at least one support shelf 114 to retain the veneer object 102 in position on veneer mounting plate 104.

Although resilient arm 206 is shown as generally perpendicular to first surface 108 of veneer mounting plate 104, resilient arm 206 could be angled such that it is not perpendicular to first surface 108 of veneer mounting plate 104. Although stabilizing arm 208 is shown as generally parallel to first surface 108 of veneer mounting plate 104, stabilizing arm 208 could be angled such that it is not parallel to first surface 108 of veneer mounting plate 104.

Although this disclosure of retention clip 116 is illustrated and described, this disclosure contemplates retention clip 116 being implemented in any other suitable manner. As just one example, resilient arm 206 may instead be rigid, and stabilizing arm 208 could be resilient, with stabilizing arm 208 being implemented as a type of spring for example.

Although support shelves 114 and retention clips 116 are illustrated and described as having particular sizes and shapes, this disclosure contemplates support shelves 114 and retention clips 116 having any suitable sizes and shapes, according to particular implementations. For example, support shelves 114 are shown to have a half-moon shape; however, support shelves 114 could have a rectangular or other suitable shape. As another example, retention clips 116 are shown to have a generally L-shape; however, retention clips 116 could have other suitable shapes.

Although veneer mounting plate 104 includes a particular number of support shelves 114 and retention clips 116, this disclosure contemplates veneer mounting plate 104 including any suitable number of support shelves 114 and retention clips 116, according to particular implementations.

Additionally, veneer mounting plate 104 is shown as having a regular repeating pattern with retention clips 116 aligned in columns and rows and support shelves 114 aligned in columns and rows to create rows of parallel channels 204 for placement of veneer objects 102. Although retention clips 116 and support shelves 114 are shown in this regular repeating pattern, this disclosure contemplates veneer mounting panel 104 including any suitable arrangement of support shelves 114 and retention clips 116. The arrangement of support shelves 114 and retention clips 116 may be selected to accommodate a variety of sizes and shapes of veneer objects 102 to create particular patterns veneer objects 102 on veneer mounting plate 104, and ultimately on the wall of the structure.

Support shelves 114 and retention clips 116 may be integral to and formed of the same material as veneer mounting plate 104. As just one example, veneer mounting plate 104, support shelves 114, and retention clips 116 may be formed of stainless steel. Voids 210 may be present where support shelves 114 and retention clips 116 are cut from veneer mounting plate 104. Additionally or alternatively, this disclosure contemplates some or all of support shelves 114 and retention clips 116 being formed, in whole or in part, of a different material than veneer mounting plate 104 and attached to veneer mounting plate 104 in any suitable manner.

As described above with reference to FIGS. 1A-1C, veneer mounting plate 104 includes one or more stiffening ribs 118. Additionally, as described above with reference to FIGS. 1A-1C, in certain embodiments, veneer mounting plate 104 includes one or more apertures 124 for placement of fasteners 128 to engage with one or more elements of a panel mounting system 106 (e.g., with a corresponding panel attachment element 126*a*-126*c* of panel mounting system 106).

FIG. 3 illustrates a side view of an example process for attaching a veneer object 102 to veneer mounting plate 104, according to certain embodiments of this disclosure. FIG. 3 illustrates the attachment process using three veneer objects 102*a*-102*c* at different stages 300*a*-300*c* of the attachment process on a veneer mounting plate 104.

At stage 300*a*, as shown using veneer object 102*a*, a first edge 302 of veneer object 102*a* is inserted into channel 204*a* between at least one retention clip 116 and at least one support shelf 114. Edge 302 of veneer object 102*a* contacts stabilizing arm 208 of retention clip 116, and veneer object 102*a* is at an angle relative to first surface 108 of veneer mounting plate 104.

At stage 300*b*, as shown using veneer object 102*b*, an installer may apply one or more forces to veneer object 102*b* to begin moving veneer object 102*b* into position on veneer mounting plate 104. For example, an installer may push veneer object 102*b* in the general direction of retention clip 116 (as shown at indicator 304) and inward in the general direction of first surface 108 of veneer mounting plate 104 (as shown at indicator 306) to move veneer object 102*b* into position on veneer mounting plate 104 (and ultimately achieve the state shown at stage 300*c*). These generally upward and inward forces may be applied separately or partially or entirely simultaneously.

The generally upward force applied by the installer causes resilient arm 206 to bend (as shown at indicator 306), creating sufficient space in channel 204*b* for the installer to rotate a second edge 308 (opposite edge 302) of veneer object 102*b* into the channel 204*b*, so that edge 308 can be positioned on support shelf 114.

At stage 300*c*, as shown using veneer object 102*c*, the generally upward force applied by the installer of veneer object 102 (as shown at stage 300*b*) has been released, and veneer object 102*c* has been rotated into position in channel 204*c* (not labeled due to the presence of veneer object 102*c* in channel 204*c*) such that veneer object 102*c* is attached to veneer mounting plate 104. As can be seen, the release of the upward force applied by the installer on veneer object 102*c* allows the bend in resilient arm 206 to decrease (as shown at indicator 310), but resilient arm 206 still applies sufficient force (via stabilizing arm 208), which may be described as a holding force, in the direction of at least one support shelf 114 (e.g., direction 312) to retain veneer object 102*c* in position on veneer mounting plate 104.

At stage 300*c*, retention clip 116 (e.g., stabilizing arm 208) contacts edge 302 of veneer object 102*c* and support shelf 114 contacts edge 308 of veneer object 102*c*, and veneer object 102*c* is retained in position on veneer mounting plate 104 at least in part by retention clip 116 and support shelf 114. For example, retention clip 116 retains veneer object 102*c* in position in channel 204*c* by applying a holding force against edge 302 of veneer object 102*c* in the direction (direction 312) of the support shelf 114 that contacts edge 308 of veneer object 102*c*. If desired, an amount of adhesive may be applied between veneer objects 102 and veneer mounting plate 104 to further secure veneer objects 102 to veneer mounting plate 104.

FIG. 4 illustrates a side view of attachment of a panel attachment element 126 to a veneer mounting plate 104, according to certain embodiments of this disclosure. For purposes of this example, it will be assumed that panel attachment element 126 is panel attachment element 126*a*.

In the illustrated example, multiple veneer objects 102 are retained in position on veneer mounting plate 104 by corresponding at least one support shelves 112 and one or more retention clips 116. Additionally, filler material 122 has been deposited in gaps 120 between adjacent veneer objects 102.

As described with reference to FIG. 1, a given panel attachment element 126 may include a retaining base 132 and a channel 134. As shown in greater detail in the embodiment of FIG. 4, a particular panel attachment element 126*a* includes retaining base 132*a* and channel 134*a*.

In the illustrated example of FIG. 4, channel 134*a* is adapted to engage with a support rail 130*a* (e.g., of support rails 130*a*-130*c* in FIG. 1A) for installation on a wall of a structure. For example, as shown in FIGS. 1C and 5, and described in greater detail below with reference to FIG. 5, channel 134 (e.g., a channel 134*a* in FIGS. 4 and 5) is adapted to receive a protrusion (e.g., a protrusion 140*a* in FIG. 5) of a support rail 130 (e.g., a support rail 130*a* in FIGS. 4 and 5) to attach veneer mounting plate 104 to a wall of a structure.

In certain embodiments, panel attachment element 126*a* includes another channel 400. In this example, channel 400 faces an opposite direction than the direction channel 134*a* faces. Channel 400 may be adapted to receive one or more fasteners to secure panel attachment element 126*a* to a support rail 130 (e.g., support rail 130*a*), as described in greater detail with reference to FIG. 5. Channel 400 may include one or more slots 402 for insertion of one or more nuts that are part of an adjustment mechanism used to fine tune the position of veneer mounting plate 104 (e.g., the veneer panel) when attached to one or more support rails 130 (e.g., support rail 130*a*) on a wall of a structure, as described in greater detail with reference to FIGS. 5 and 6.

Panel attachment element 126*a* may attach to veneer mounting plate 104 (in this case, a veneer panel) using fastener 128. In this example, fastener 128 includes a nut 128*a* and a bolt 128*b*. As described above, a portion of fastener 128 (e.g., bolt 128*b*) may be inserted through an aperture 124 in veneer mounting plate 104 from the second surface 110-side of veneer mounting plate 104. The fastener 128 (e.g., bolt 128*b*) may be inserted through an aperture in retaining base 132*a* of panel attachment element 126*a*, and a nut 128*a* may be joined to bolt 128*b* from the first surface 108-side of veneer mounting plate 104. A lock washer 402 may be positioned between bolt 128*b* and retaining base 132*a*. In certain embodiments, opposing surfaces of retaining base 132*a* and lock washer 402 are serrated, which may enhance the engagement between retaining base 132*a* and lock washer 402 created by fastener 128.

Figure 5:
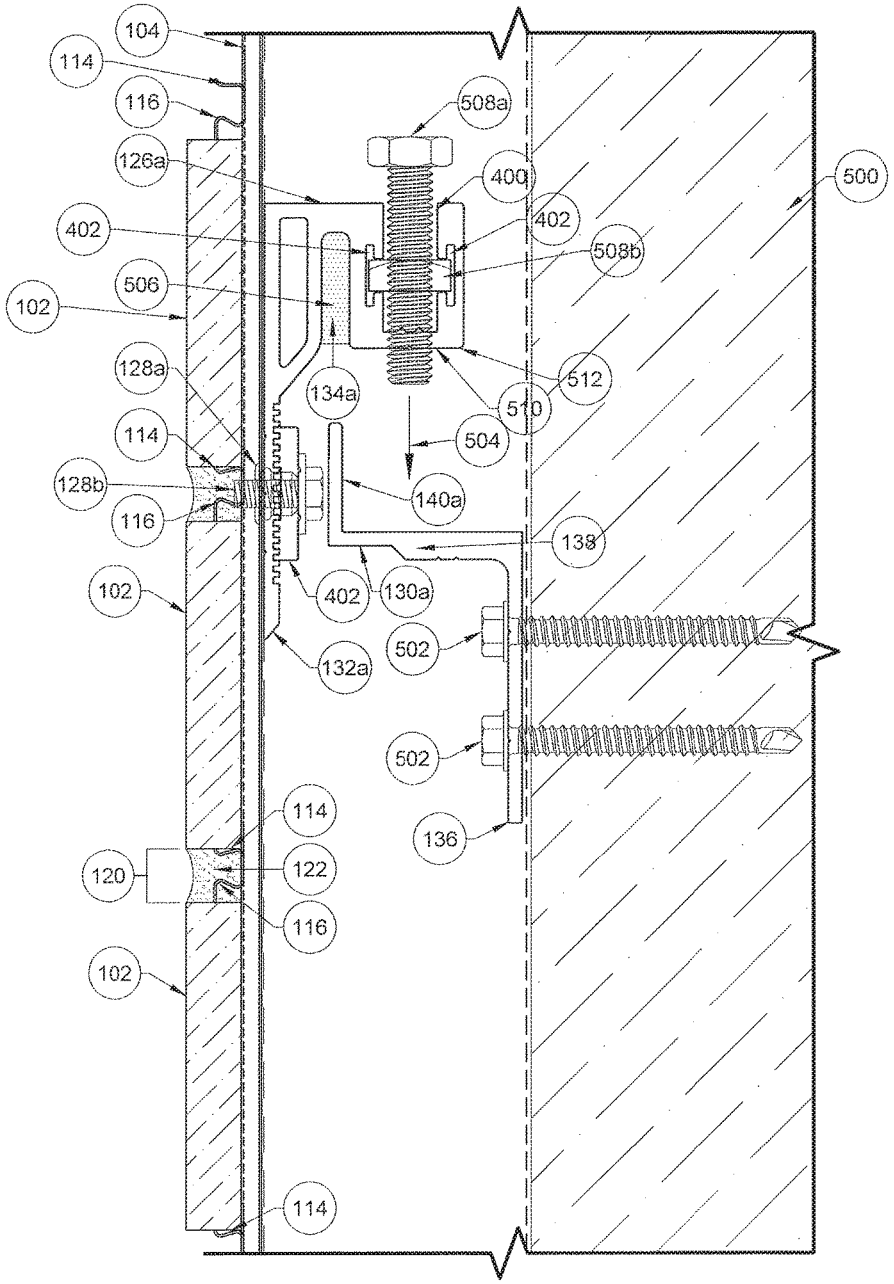
FIG. 5 illustrates a side view of the positioning of a panel attachment element attached to a veneer mounting plate as the panel attachment element is positioned for attachment to a support rail attached to a wall of a structure, according to certain embodiments of this disclosure.

FIG. 5 illustrates a side view of the positioning of a panel attachment element 126 attached to a veneer mounting plate 104 as panel attachment element 126 is positioned for attachment to a support rail 130 attached to a wall of a structure, according to certain embodiments of this disclosure. For purposes of this example, it will be assumed that panel attachment element 126 is panel attachment element 126*a*, and that support rail 130 is support rail 130*a*. Furthermore, in certain embodiments, a second (and possibly additional) panel attachment element 126*b* may be attached to veneer mounting plate 104, spaced apart from panel attachment element 126*a*, and configured to engage with corresponding support rails 130 attached to a wall of a structure. As a particular example, FIG. 6, described in greater detail below, shows a second panel attachment element 126*b* attached to second surface 110 of veneer mounting plate 104 and configured to engage with support rail 130*b*. Thus, it may be useful view FIGS. 5 and 6 together when reviewing their associated descriptions.

As shown in FIG. 5, fastener 128 has been fully engaged (e.g., nut 128*a* has been secured to bolt 128*b*), such that panel attachment element 126*a* is secured to second surface 110 of veneer mounting plate 104, with a lock washer 402 positioned between bolt 128*b* and retaining base 132*a* of panel attachment element 126*a*.

Figure 6:
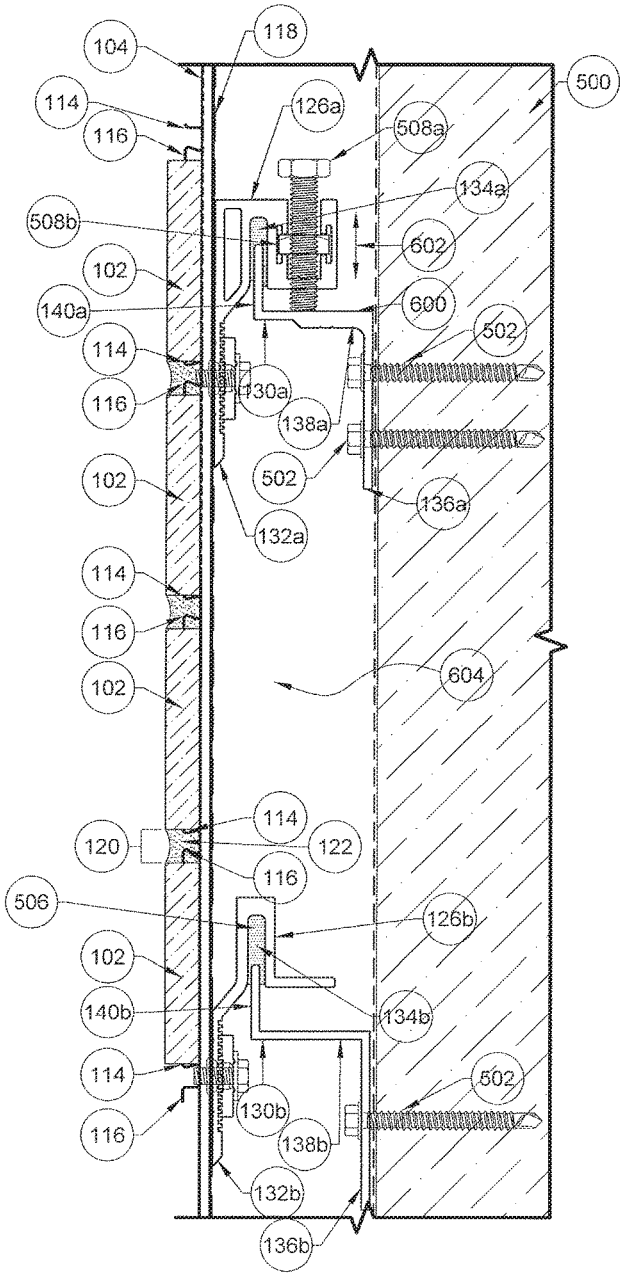
FIG. 6 illustrates a side view of the positioning of a panel attachment element attached to a veneer mounting plate when the panel attachment element is attached to a support rail attached to a wall of a structure, according to certain embodiments of this disclosure.

As shown in FIGS. 5 and 6, support rails 130*a* and 130*b* are attached to a wall 500 of a structure using one or more fasteners 502. In the illustrated example, fasteners 502 are screws; however, this disclosure contemplates using any suitable types of fasteners to attach support rails 130*a* and 130*b* to a wall 500 of a structure.

As shown, veneer mounting plate 104 (e.g., in this case, a veneer panel) is positioned such that channels 134*a* and 134*b* of panel attachment elements 126*a* and 126*b* is substantially aligned with protrusions 140*a* and 140*b* of support rails 130*a* and 130*b*. Veneer mounting plate 104 is moved in the direction of arrow 504, allowing channels 134*a* and 134*b* of panel attachment element to receive protrusions 140*a* and 140*b* of support rails 130*a* and 130*b* to attach veneer mounting plate 104 to support rails 130*a* and 130*b*, resulting in attachment of veneer mounting plate 104 (e.g., in this case, a veneer panel) to wall 500.

In certain embodiments, an adhesive 506 (e.g., silicone) may be deposited within channels 134*a* and 134*b* to assist in maintaining veneer mounting plate 126 (and thereby a veneer panel) in position on support rails 130*a* and 130*b*. Although initially relatively pliable, adhesive 506 (e.g., silicone) may harden over time to assist in maintaining veneer mounting plate 104 (and thereby a veneer panel) in position on support rails 130*a* and 130*b*. For example, because the widths of channels 134*a* and 134*b* of panel attachment elements 126*a* and 126*b* may greater than a width of protrusions 140*a* and 140*b* of support rails 130*a* and 130*b* (e.g., to provide some margin for error in attaching panel attachment elements 126*a* and 126*b* to support rails 130*a* and 130*b*), some movement of veneer mounting plate 104 (and thereby a veneer panel) toward and away from wall 500 may be possible, which could lead to undesirable shifts in position of veneer panels and potentially noise over time. Use of adhesive 506 may reduce or eliminate the ability of veneer mounting plate 104 (and thereby a veneer panel) to move toward and away from wall 500.

As illustrated in FIG. 5, in certain embodiments, an adjustment mechanism 508 may be included in panel attachment element 126*a*. Adjustment mechanism 508 allows an installer to finely tune the position of veneer mounting plate 104 (e.g., the veneer panel) when attached to one or more support rails 130*a* on wall 500. In the illustrated example, adjustment mechanism 508 includes a bolt 508*a* and a nut 508*b*. Nut 508*b* be is positioned in slots 402 of channel 400 of panel attachment element 126*a*, such that the aperture of nut 508*b* faces the opening of channel 400. Channel 400 is adapted to receive bolt 508*a*, which may then be inserted through the aperture of nut 508*b* and through a corresponding aperture 510 in a base 512 of channel 400.

Although a single adjustment mechanism 508 is illustrated, this disclosure contemplates multiple adjustment mechanisms 508 being positioned along panel attachment element 126*a* (e.g., along channel 400 of panel attachment element 126*a*) at suitable intervals. As just one example, an adjustment mechanism 508 may be positioned toward each end of panel attachment element 126. Although this particular adjustment mechanism 508 is described, this disclosure contemplates any suitable adjustment mechanism being used.

In scenarios in which adhesive 506 is deposited in channel 134 of panel attachment element 126, adhesive 506 being in a pliable state for a period of time may allow an installer to make suitable adjustments to the position of veneer mounting plate 104 on support rail 130 (using adjustment mechanism(s) 508) prior to adhesive 506 hardening and setting the position of veneer mounting plate 104 (e.g., in this case, a veneer panel).

Although a single panel attachment element 126*a* and support rail 130*a* are shown in FIG. 5, it will be appreciated that multiple panel attachment elements 126*a* may be attached to a veneer mounting plate 104 and configured to attach to a corresponding multiple support rails 130*a* attached to wall 500.

FIG. 6 illustrates a side view of the positioning of panel attachment elements 126*a* and 126*b* attached to a veneer mounting plate 104 when panel attachment elements 126*a* and 126*b* are attached to respective support rails 130*a* and 130*b* attached to a wall 500 of a structure, according to certain embodiments of this disclosure.

Although largely similar to the embodiment shown in FIG. 5, FIG. 6 shows the inclusion of two panel attachment elements 126 (labeled 126*a* and 126*b*) and two support rails 130 (labeled 130*a* and 130*b*). Although a particular number of panel attachment elements 126 and support rails 130 are shown in FIG. 6, it will be appreciated that any suitable number of panel attachment elements 126 and support rails 130 may be included.

As shown in FIG. 6, panel attachment elements 126*a* and 126*b* have been moved into position (in this example, lowered) such that protrusions 140*a* and 140*b* of support rails 130*a* and 130*b* have been inserted into respective channels 134*a* and 134*b* of respective panel attachment elements 126*a* and 126*b*. For example, protrusion 140*a* of support rail 130*a* is positioned within channel 134*a* of panel attachment element 126*a* and protrusion 140*b* of support rail 130*b* is positioned within channel 134*b* of panel attachment element 126*b*.

With reference to FIG. 6, bolt 508*a* of adjustment mechanism 508 is in contact with a surface 600 of support arm 138*a* of support rail 130*a*. To fine tune the position of veneer mounting plate 104, bolt 508*a* may be rotated clockwise or counterclockwise, which may raise or lower the position of veneer mounting plate 104, as shown by arrows 602.

In certain embodiments, as described above with reference to FIG. 5, multiple adjustment mechanisms 508 are positioned along panel attachment element 126 (e.g., along channel 400 of panel attachment element 126) at suitable intervals. As just one example, an adjustment mechanism 508 may be positioned toward each end of panel attachment element 126. In such an example, adjusting adjustment mechanisms 508, either alone or in combination, may allow an installer to adjust the leveling of veneer mounting plate 104 or to adjust the height of veneer mounting plate 104.

As shown in FIG. 6, in certain embodiments, the exact shape and configuration of elements of panel attachment elements 126 may vary, depending on the position of the panel attachment element 126 on veneer mounting plate 104.

For example, in certain embodiments, only certain panel attachment elements 126 include channel 400 for use of adjustment mechanism 508. As just one particular example, in certain embodiments, the top-most panel attachment element 126*a* (when attached to veneer mounting plate 104) may include channel 400 for use of adjustment mechanism 508 because, in some implementations, that adjustment mechanism 508 would be accessible to an installer during attachment of veneer mounting plate 104 to support rails 130 using panel attachment elements 126. Of course, this disclosure contemplates all panel attachment elements 126 attached to a veneer mounting plate 104 having the same shape and configuration, if desired.

As another example, in certain embodiments, certain support rails 130 (e.g., support rail 130*a*) are attached to wall 500 using more fasteners 502 than other support rails 130 (e.g., support rail 130*b*). Of course, this disclosure contemplates all support rails 130*a* and 130*b* being attached to wall 500 using the same number of fasteners, if desired.

As discussed above with reference to FIG. 1, in certain embodiments, when a veneer panel is coupled to a wall (e.g., wall 500 of FIGS. 5-6) of a structure using panel mounting system 106, panel attachment elements 126 cooperate with corresponding support rails 130 to provide one or more types of support for the veneer panel. As just one example, in some implementations when a veneer panel is attached to wall 500 using panel mounting system 106, panel attachment element 126*a* (in cooperation with corresponding support rail 130*a*) is configured to support a dead load of the veneer panel to which it is attached and panel attachment element 126*b* (in cooperation with corresponding support rail 130*b*) is configured to provide lateral support for the veneer panel. Although two panel attachment elements 126*a* and 126*b* and two corresponding support rails 130*a* and 130*b* are illustrated in FIG. 6, this disclosure contemplates additional panel attachment elements 126 and corresponding support rails 130 (e.g., such as panel attachment element 126*c* and corresponding support rail 130*c*) being used and providing appropriate support for the veneer panel. Furthermore, this disclosure contemplates panel attachment elements 126 (and corresponding support rails 130) providing any suitable type of support, alone or in combination, as may be appropriate for particular implementations.

In certain embodiments, the mechanical attachment feature coupled with the veneer panels being attachable to a wall using a panel mounting system (e.g., panel mounting system 106) provides a mechanically-attached ventilated backdrop rainscreen cladding system. For example, veneer panels mounted to a wall 500 of a structure create a "second skin" for the walls 500 of the structure, possibly enhancing the aesthetic appearance of the structure and providing a "double-wall" feature. As another example, in addition to potentially enhancing the aesthetic appearance, the veneer objects 102/veneer panels provide a layer of protection from weather elements (e.g., functioning as a rain screen). As another example, a cavity 604 between the veneer panel and wall 500 (e.g., between second surface 110 of veneer mounting plate 104 and wall 500) provides ventilation to the system, allowing for pressure equalization and for moisture that reaches cavity to drain and/or evaporate. In certain embodiments, if desired, an insulation material may be provided in cavity 604. In certain embodiments, if desired, a weather resistant barrier may be positioned along the surface of wall 500 such that it is located between support rail bases 136*a* and 136*b* of support rails 130*a* and 130*b* and wall 500.

Figure 7:
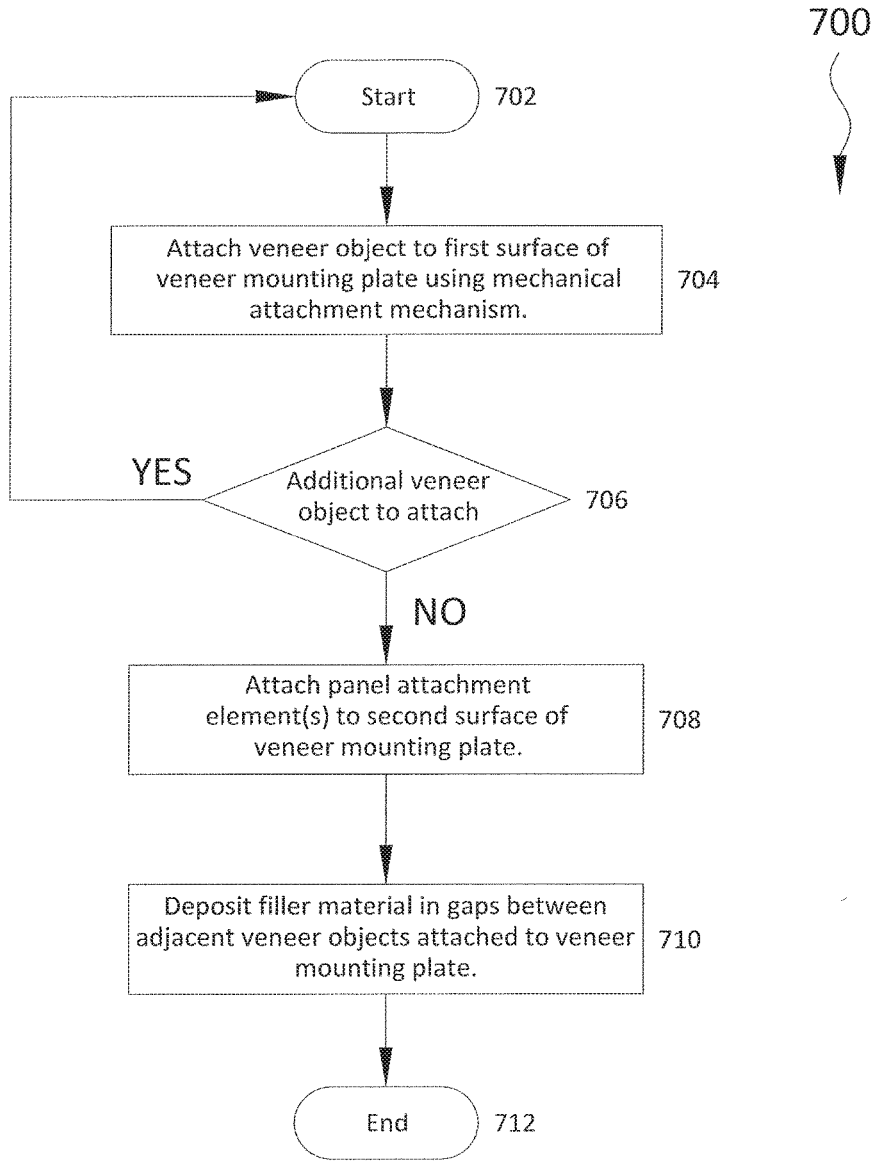
FIG. 7 illustrates an example method for forming a veneer panel, according to certain embodiments of this disclosure.

FIG. 7 illustrates an example method 700 for forming a veneer panel, according to certain embodiments of this disclosure. At step 702, the method begins.

At step 704, a veneer object 202 is attached to a first surface 108 of veneer mounting plate 104 using a mechanical veneer attachment mechanism. In certain embodiments, attaching a veneer object 102 to first surface 108 of veneer mounting plate 104 using a mechanical attachment mechanism includes positioning a first edge 302 of veneer object 102 against one or more retention clips 116, applying a force against the resilient, or holding, force of the one or more retention clips 116, rotating the veneer object 102 toward first surface 108 of veneer mounting plate 104 such that second edge 308 of veneer object 102 engages with one or more support shelves 114, and releasing the force applied against the resilient, or holding, force of the one or more retention clips 116 such that the one or more retention clips 116 and the one or more support shelves 114 at least partially retain the veneer object 102 in position on veneer mounting plate 104. As a particular example, a veneer object 102 may be attached to veneer mounting plate 104 using the attachment process illustrated and described above with reference to FIG. 3.

At step 706, a determination is made whether another veneer object 102 is to be attached to veneer mounting plate 104. If it is determined that another veneer object 102 is to be attached to veneer mounting plate 104, then method 700 returns to step 704 to attach another veneer object 102 to veneer mounting plate 104. If it is determined that another veneer object 102 is not to be attached to veneer mounting plate 104, then method 700 may proceed to step 708.

At step 708, one or more panel attachment elements 126 are attached to a second surface 110 of veneer mounting plate 104. For example, a suitable number of panel attachment elements 126 (e.g., suitable for engaging with corresponding support rails on a wall 500 of a structure), may be attached to second surface 110 of veneer mounting plate 104 using an appropriate number of fasteners 128. In embodiments in which panel attachment elements 126 are integrally formed on the second surface 110 of veneer mounting plate 104 such that the desired number of panel attachment elements 126 are already part of veneer mounting plate 104, then step 708 may be omitted.

At step 710, a filler material 122 may be deposited in gaps 120 that separate adjacent veneer objects 102 attached to veneer mounting plate 104. It should be understood that this disclosure contemplates depositing filler material 122 in gaps 120 at any suitable time, including before or after a veneer panel has been installed on a wall of a structure (e.g., by attachment of the veneer panel to one or more support rails 130).

At step 712, the method ends.

Figure 8:
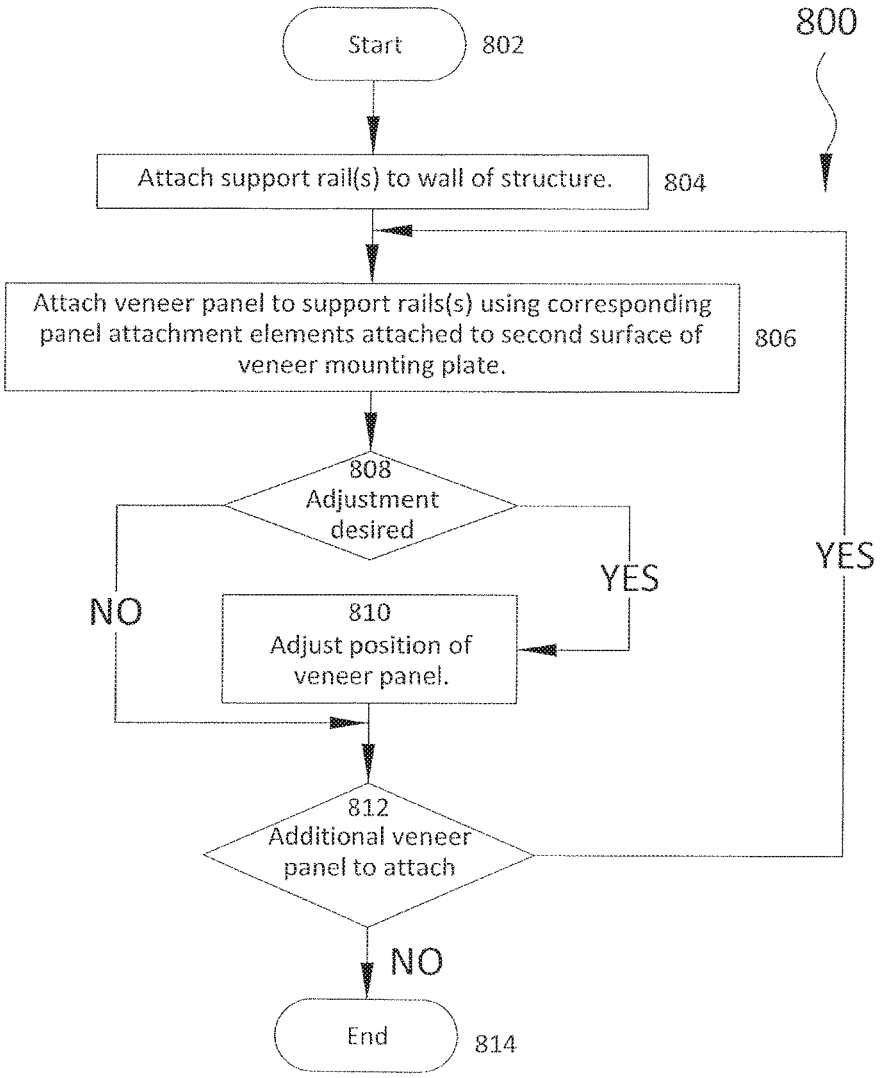
FIG. 8 illustrates an example method for attached a veneer panel to a wall of a structure, according to certain embodiments of this disclosure.

FIG. 8 illustrates an example method 800 for attached a veneer panel to a wall of a structure, according to certain embodiments of this disclosure. At step 802, the method begins. Although attachment of veneer panels is described, this disclosure contemplates attachment of a veneer mounting plate 104 prior to attachment of veneer objects 102, if desired.

At step 804, one or more support rails 130 may be attached to a wall 500 of a structure.

At step 806, a veneer panel is attached to one or more support rails 130 are attached to a wall 500 of a structure using one or more corresponding panel attachment elements 126 on the second surface 110 of the veneer mounting plate 104. For example, an installer may position the veneer panel such that a projection 140 of each support rail 130 is inserted into and engages with a channel 134 of corresponding panel attachment elements 126 on the second surface 110 of veneer attachment plate 104. As described above, an adhesive 506 may be deposited in channels 134 of the panel attachment elements 126, if desired.

At step 808, a determination is made whether an adjustment of the position of the attached veneer panel. If a determination is made that an adjustment is not desired, then method 800 may proceed to step 812. If a determination is made that an adjustment is desired, then adjustment mechanism 508 may be used to adjust the position of the veneer panel. For example, an installer may use adjustment mechanism 508 to fine tune the position of the veneer panel. Such fine-tuning may include, for example, adjusting the overall height of the veneer panel and/or leveling the veneer panel.

At step 812, a determination is made whether another veneer panel is to be attached to support rails 130 attached to wall 500. If it is determined that another veneer panel is to be attached to support rails 130 attached to wall 500, then method 800 returns to step 806 to attach another veneer panel to one or more support rails 130. If it is determined that another veneer panel is not to be attached to support rails 130, then at step 814 method 800 may end.

Although in describing or illustrating certain processes and methods, this disclosure describes or illustrates particular steps as occurring in a particular order, this disclosure contemplates the steps being performed in any suitable order. Moreover, this disclosure contemplates any suitable steps being repeated one or more times in any suitable order. Although this disclosure describes or illustrates particular steps as occurring in sequence, this disclosure contemplates any suitable steps occurring at substantially the same time, where appropriate.

Figure 9A:
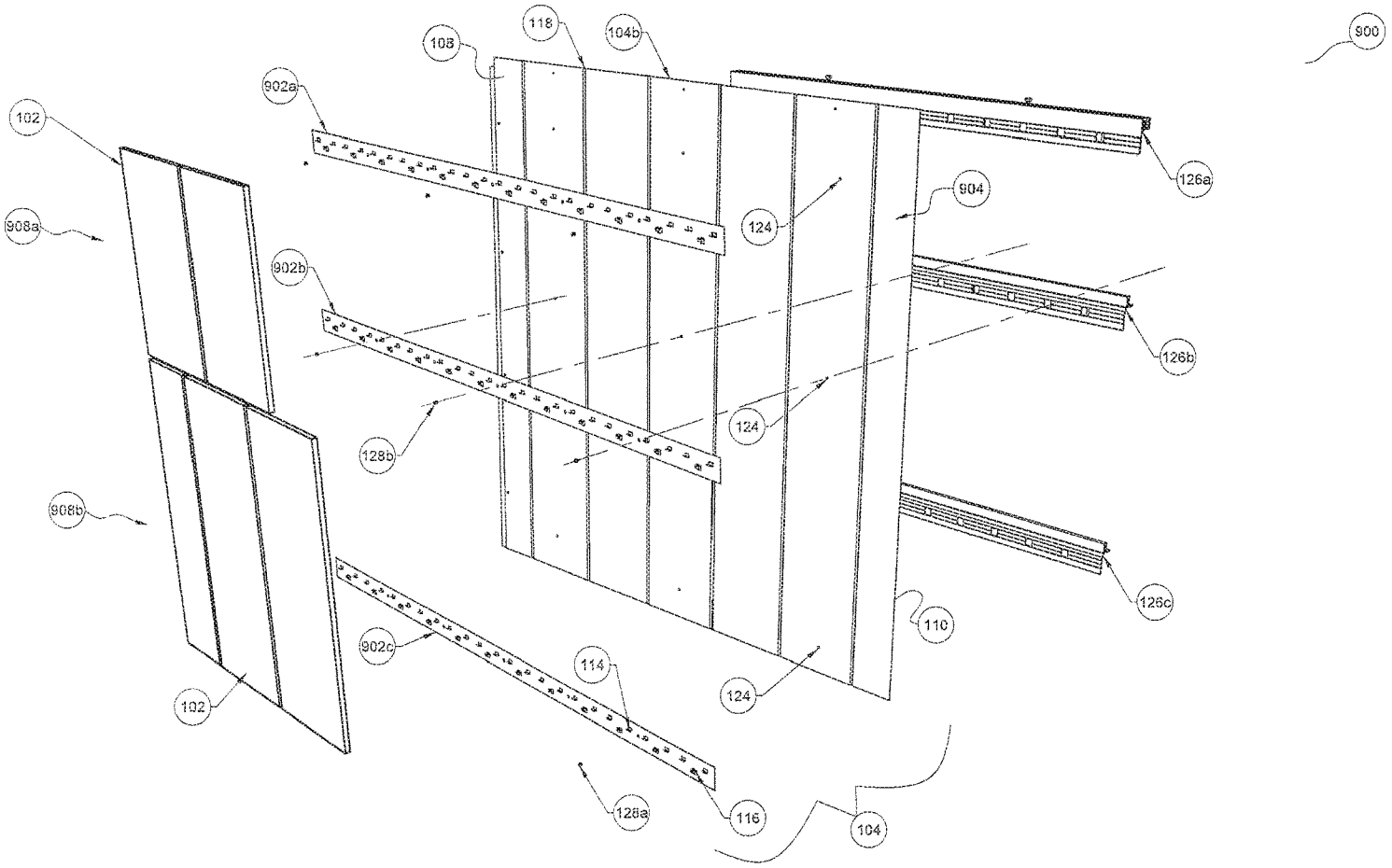
FIGS. 9A-9C illustrate various views of an example embodiment in which mechanical attachment mechanisms for attaching veneer objects are formed on veneer object attachment strips that are attachable to a substrate to form a veneer mounting plate, according to certain embodiments of this disclosure.
Figure 9B:
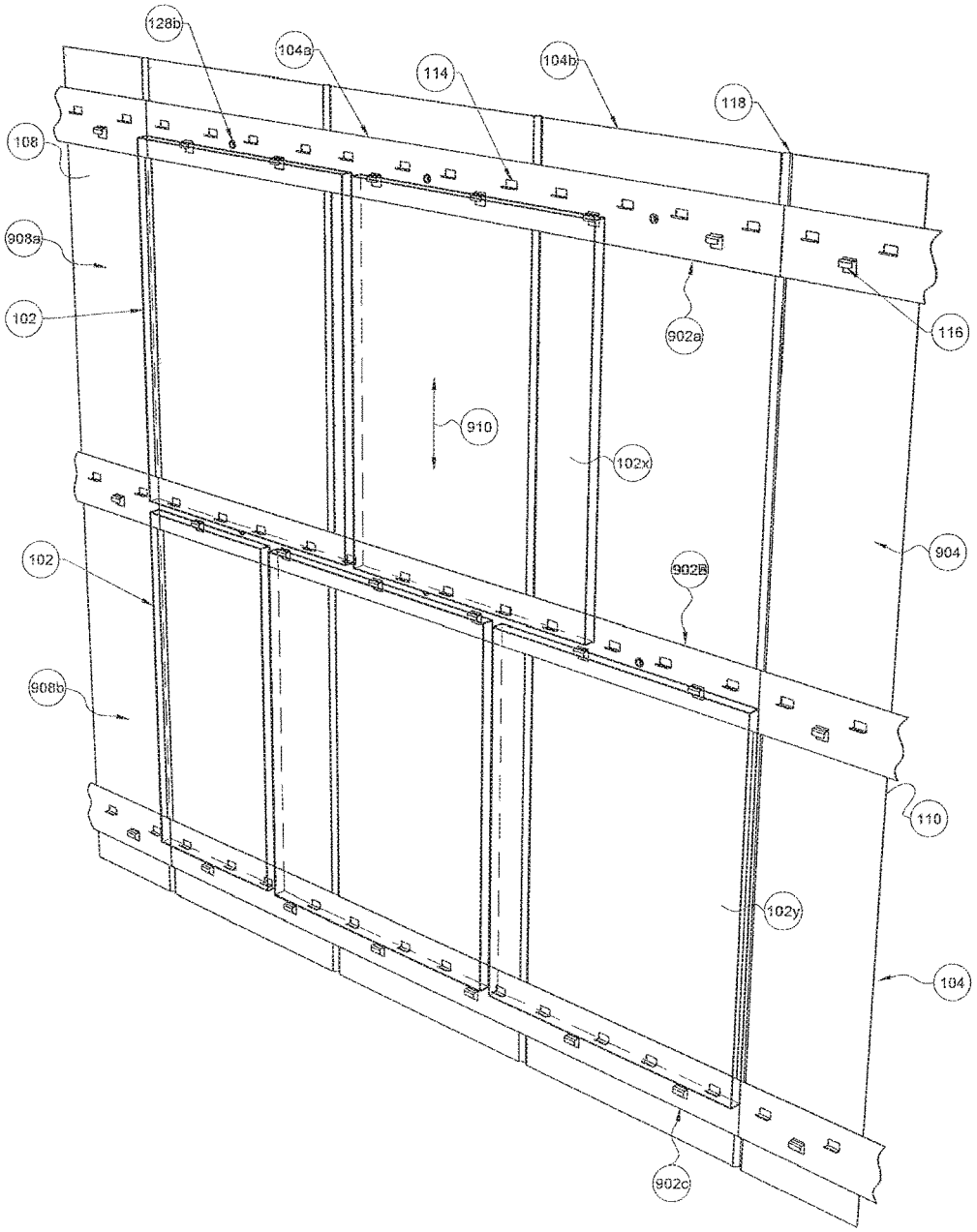
Figure 9C:
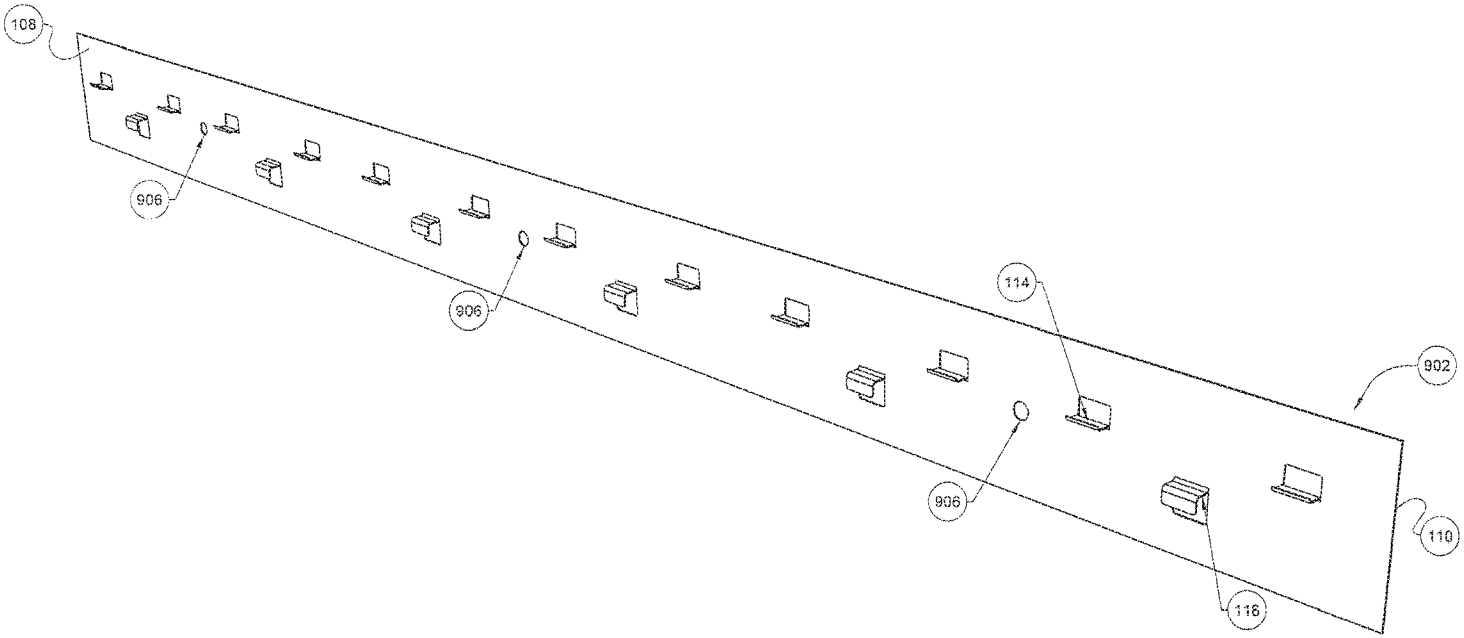

FIGS. 9A-9C illustrate various views of an example embodiment in which mechanical attachment mechanisms for attaching veneer objects 102 are formed on veneer object attachment strips that are attachable to a substrate to form a veneer mounting plate 104, according to certain embodiments of this disclosure. In particular, FIG. 9A illustrates an example system 900 in which veneer object attachment strips 902 (902*a*-902*c*) are used, FIG. 9B illustrates an example in which veneer object attachment strips 902*a*-902*c* have been attached to a substrate 904 to form a veneer mounting plate 104, and FIG. 9C illustrates an example veneer object attachment strip 902, all according to certain embodiments of this disclosure.

As shown in FIG. 9A, in certain embodiments, system 900 shares many features in common with system 100, and therefore those features are not described in detail again with reference to FIGS. 9A-9C. In system 900, however, the mechanical attachment mechanisms for attaching veneer objects 102 to veneer mounting plate 104 are formed on one or more veneer object attachment strips 902 (e.g., veneer object attachment strips 902*a*, 902*b*, and 902*c*, as illustrated in FIGS. 9A-9B).

In the illustrated example, each veneer object attachment strip 902 includes multiple support shelves 114 and multiple retention clips 116. Although also shown in FIGS. 9A and 9B, FIG. 9C illustrates these features in greater detail. As described below with reference to FIG. 9B, one or more retention clips 116 of one of veneer object attachment strips 902 cooperate with one or more support shelves 114 of an adjacent (e.g., vertically lower) veneer object attachment strip 902 to attach veneer objects 102 to the resulting veneer mounting plate 104.

Substrate 904 is a sheet of material to which veneer object attachment strips 902 may be attached. Substrate 904 has a first surface 108 and a second surface 110 that correspond to first surface 108 and second surface 110, respectively, of veneer mounting plate 104. Substrate 904 may include one or more apertures 124. Some of apertures 124 may be used for attaching veneer attachment strips 902 to first surface 108 of substrate 904, and some of apertures 124 may be used to attach panel attachment elements 126 to second surface 110 of substrate 904. This disclosure contemplates the same apertures 124 of substrate 904 may be used for inserting fasteners (e.g., fasteners 128, such as bolts 128*b*) to attach both veneer object attachment strips 902 and panel attachment elements 126 to substrate 904. In certain embodiments, substrate 904 includes one or more stiffening ribs 118 similar to stiffening ribs 118 of veneer mounting plate 104 shown and described with reference to other figures.

Veneer object attachment strips 902 can be attached to first surface 108 of substrate 904. In this example, the combination of the substrate 904 and the veneer attachments strips 902 attached to the substrate 904 may be referred to as a veneer mounting plate 104 or an assembled veneer mounting plate 104. Veneer object attachment strips 902 are attached to substrate 904 at suitable locations to accommodate the arrangement of veneer objects 102 to be attached to the assembled veneer mounting plate 104. Veneer object attachment strips 902 may be attached to substrate 904 prior to attaching the plurality of veneer objects 102 to first surface 108 of veneer mounting plate 104 using the respective mechanical attachment mechanisms of veneer object attachment strips 902, Veneer object attachment strips 902 may be attached to substrate 904 in any suitable manner and using any suitable attachment mechanism. Veneer object attachment strips 902 may be attached to substrate 904 using one or more fasteners (e.g., nuts 128*a* and bolts 128*b* of fastener 128), an adhesive, or any other suitable type of attachment mechanism, alone or in combination.

As illustrated in FIGS. 9A-9C, fasteners (e.g., fasteners 128) may be inserted through apertures 906 in veneer object attachment strips 902 (e.g., in veneer object attachment strips 902*a*-902*c*) and through corresponding apertures 124 in substrate 904. The apertures 124 in substrate 904 may be pre-positioned (e.g., prior to installation), or may be formed (e.g., by drilling) by an installer when the desired location of veneer object attachment strips 902 on substrate 904 are determined.

In the illustrated example, apertures 906 of veneer object attachment strips 902 align with corresponding apertures 124 in substrate 904. That is, in the illustrate example, apertures 906 align with the apertures 124 in substrate 904 that are used to attach panel attachment elements 126 to second surface 110 of veneer mounting plate 104 (e.g., to second surface 110 of substrate 904 in the example illustrated in FIG. 9A) such that a same fastener 128 (e.g., combination of nut 128*a* and bolt 128*b*) may be used to attach a veneer object attachment strip 902 to first surface 108 of substrate 104 and to attach panel attachment element 126 to second surface 110 of substrate 904.

Although this arrangement for attaching veneer object attachment strips 902 (and panel attachment elements 126) to substrate 904 is illustrated and primarily described, this disclosure contemplates veneer object attachment strips 902 being attached to first surface 108 of substrate 904 in any suitable manner, using any suitable types of fasteners (fasteners 128 or otherwise), and at any suitable locations of substrate 904.

In certain embodiments, veneer object attachment strips 902 and substrate 904 are formed of stainless steel; however, this disclosure contemplates veneer object attachment strips 902 and substrate 904 being formed of any suitable materials, according to particular needs. Veneer object attachment strips 902 and substrate 904 may be formed of different materials, if appropriate. Factors that may contribute to determining a suitable material for veneer object attachment strips 902 and/or substrate 904 may include any suitable combination of the weight and dimensions of the veneer objects 102 that are to be attached, the height of the installation (e.g., the height of the wall on which the veneer panels are to be installed), the location of the installation (e.g., interior vs. exterior and/or the environmental conditions, such as the climate), and any other suitable factors.

FIG. 9B illustrates a state in which veneer object attachment strips 902*a*-902*c* have been attached to substrate 904 (e.g., using fasteners 128, including the illustrated bolts 128*b*) to form a veneer mounting plate 104 and in which veneer objects 102 have been attached to the resulting veneer mounting plate 104 using the mechanical attachment mechanisms of veneer object attachment strips 902*a*-902*c*.

In the illustrated example, a veneer object 102*x* is one of multiple veneer objects 102 attached to the resulting veneer mounting plate 104 using one or more retention clips 116 of a first veneer object attachment strip 902*a* and one or more support shelves 114 of a second veneer object attachment strip 902*b*, forming a row first 908*a* of veneer objects 102. Also in the illustrated example, a veneer object 102*y* is one of multiple veneer objects 102 attached to the resulting veneer mounting plate 104 using one or more retention clips 116 of the veneer object attachment strip 902*b* and one or more support shelves 114 of a third veneer object attachment strip 902*c*, forming a second row 908*b* of veneer objects 102.

In the example shown in FIG. 9B (as well as FIG. 9A), veneer objects 102 (e.g., veneer object 102*x*) in row 908*a* are shorter (along axis 910) than veneer objects 102 (e.g., veneer object 102*y*) in row 908*b*. Although a veneer mounting plate 104 on which the mechanical attachment mechanisms (e.g., support shelves 114 and retention clips 116) are integrally formed could be specifically designed to accommodate essentially any desired design, the ability to position veneer object attachment strips 902 at various locations on substrate 904 may provide a more flexible design that can be more efficiently implemented to accommodate a variety of sizes and shapes of veneer objects 102 in a way that might take more time to design for integrally-formed mechanical attachment mechanisms. The ability to position veneer object attachment strips 902 in various locations on substrate 904 may provide a flexibility in creating, potentially even in the field during installation, veneer panels that accommodate a variety of veneer object 102 shapes and arrangements.

Although the illustrated examples of FIGS. 9A-9C show a particular arrangement of veneer object attachment strips 902 and each veneer object attachment strip 902 having particular portions of mechanical attachment mechanisms for attachment of veneer objects 102, this disclosure contemplates veneer object attachment strips 902 being arranged differently or having different portions of mechanical attachment mechanisms.

For example, rather than the one or more support shelves 114 and the one or more retention clips 116 for attaching a veneer object 102 being on different veneer object attachment strips 902, a particular veneer object attachment strip 902 may include both the one or more support shelves 114 and the one or more retention clips 116 for attaching a veneer object 102. In such a case, the veneer object attachment strips 902 may be provided in a variety of sizes to accommodate different sizes of veneer objects 102.

As another example, although both support shelves 114 and retention clips 116 are shown on each veneer object attachment strip 902, and although a particular number of each of support shelves 114 and retention clips 116 are shown on each veneer object attachment strip 902, this disclosure contemplates each veneer object attachment strip 902 including only support shelves 114, only retention clips 116, or both support shelves 114 and retention clips 116 in any suitable arrangements and numbers.

As another example, although described as "strips," this disclosure contemplates veneer object attachment strips 902 having any suitable shapes and dimensions. Additionally, a combination of various shapes and dimensions of veneer object attachment strips 902 could be used, if appropriate. This may allow a complex arrangement of varying veneer objects 102 to be attached to substrate 904.

These examples are just a few non-limiting examples of the many possible configurations of veneer object attachment strips 902. In certain embodiments, apertures 124 in substrate 904 may be provided in a variety of locations on substrate 904 to provide a number of possible installation locations for and sizes and shapes of veneer object attachment strips 902.

Although described separately, the embodiments of system 100 and system 900 could be used in a same installation, if desired. For example, one or more veneer panels in an installation could be implemented in a manner similar to system 100, while other veneer panels in the installation could be implemented in a manner similar to system 900 (e.g., using veneer object attachment strips attached to a substrate).

Particular embodiments of this disclosure may provide one or more technical advantages. For example, in certain embodiments, mechanical attachment mechanisms (e.g., one or more support shelves 114 and one or more retention clips 116) of veneer mounting plate 104 retain veneer objects 102 (e.g., thin bricks) in position on veneer mounting plate 104 via a mechanical attachment.

In certain embodiments, veneer mounting plate 104 allows for the formation of preassembled veneer panels to which multiple veneer objects 102 have been attached prior to attachment of the veneer panel to a wall 500 of a structure. For example, prior to attachment of a veneer mounting plate 104 to a wall 500 of a structure, a first surface 108 of veneer mounting plate 104 (what will be the "front" surface of veneer mounting plate 104 when the veneer mounting plate 104 is attached to wall 500 of a structure) may be covered with a desired number of veneer objects 102 that have been attached to veneer mounting plate 104 using mechanical attachment mechanisms of the veneer mounting plate 104. It may be possible to preassemble these veneer panels at a first location (e.g., a production facility) and ship the preassembled veneer panels to a second location (e.g., a construction site) to be attached to a wall 500 of a structure.

This preassembly capability may allow a large number of veneer objects 102 (e.g., thin bricks) to be assembled into a finished veneer panel at a production facility, with the veneer objects 102 pre-installed and properly coursed and the veneer panel ready to attach to a wall 500 of a structure (e.g., using a panel attachment system 106). The veneer panel may be self-supporting to allow for easy handling and shipping (including long-distance shipping) to projects anywhere in the world. This preassembly capability may reduce or eliminate in-the-field assembly of the veneer panel, which can lead to inconsistent results and slow the installation process.

In certain embodiments, due at least in part to the mechanical nature of the attachment of veneer objects 102 to the veneer mounting plate 104 and/or the preassembly of veneer panels, it may be possible/permissible (e.g., via appropriate regulations) to attach veneer panels to a wall 500 of a structure at greater heights than would be possible with previous and existing systems. As just one specific example, it may be possible to attach veneer panels to a wall 500 of a structure at heights exceeding four hundred feet.

Some types of veneer objects 102 (e.g., thin bricks) may be available in standard sizes. In certain embodiments, the mechanical attachment mechanism of the veneer mounting plate 104 (e.g., the support shelves 114 and retention clips 116 of veneer mounting plate 104) are designed to fit with standard-sized veneer objects 102 (e.g., standard-sized thin bricks) without requiring specialized shaped and sized veneer objects 102. Thus, certain embodiments of this disclosure do not require specially-designed veneer objects 102 (e.g., thin bricks) that are specific to the system.

In certain embodiments, the veneer mounting plate 104, including potentially the mechanical attachment mechanism (e.g., support shelves 114 and retention clips 116), is made of stainless steel or another durable material, which may provide for a long life and unique properties that the material (e.g., stainless steel) lends to the mechanical attachment process.

In certain embodiments, veneer mounting plate 104 is designed to fit with a panel attachment system 106 (for attachment to a wall 500 of a structure), which may provide for an easy and flexible installation process. In certain embodiments, the mechanical attachment feature coupled with the veneer panels being attachable to a wall 500 using a panel attachment system 106, provides a mechanically-attached ventilated backdrop rainscreen cladding system. Additionally or alternatively, in certain embodiments, the mechanical attachment feature coupled with being part of an engineered system allows veneer panels to be attached at heights greater than previous and existing systems.

In certain embodiments, even after attachment of a veneer panel to a panel attachment system 106 (attached to a wall 500 of a structure), veneer panels may still be adjusted independently (e.g., using an adjustment mechanism) for proper alignment on the wall 500 of the structure.

Although this disclosure has been described with several embodiments, a myriad of changes, variations, alterations, transformations, and modifications may be suggested to one skilled in the art, and it is intended that this disclosure encompass such changes, variations, alterations, transformation, and modifications as they fall within the scope of the appended claims.

Use of directional terms such as horizontal, vertical, upward, downward and the like are used for ease of description only. Although the figures and accompanying description may describe a system in accordance with certain embodiments of this disclosure that is oriented in a particular direction, this disclosure contemplates the components of the system being oriented in different directions than those described, according to particular needs. As just one example, the components of system 100 may be flipped such that components described as extending upward extend downward and components described as extending downward extend upward.

What is claimed is:

1. A system, comprising:

a support rail configured to attach to a wall;

a veneer mounting plate configured to attach to the wall via the support rail, the veneer mounting plate including:

a first surface;

a second surface opposite the first surface and adapted to face the wall when the veneer mounting plate is attached to the wall via the support rail;

a first support shelf extending from the first surface, the first support shelf being cut from the veneer mounting plate; and a first retention clip extending from the first surface, the first retention clip being cut from the veneer mounting plate, the first support shelf and the first retention clip being spaced apart in a first direction such that a first channel is formed between the first retention clip and the first support shelf;

a veneer object attached to the veneer mounting plate in the first channel by the first retention clip and the first support shelf, the veneer object having a first edge and a second edge opposite the first edge, the first retention clip configured to contact the first edge and the first support shelf configured to contact the second edge, the veneer object being retained in position on the veneer mounting plate at least in part by the first retention clip and the first support shelf, wherein the first retention clip retains the veneer object in position in the first channel by applying, through an actively-engaged resilient property of the first retention clip, a holding force against the first edge of the veneer object in the direction of the first support shelf.

2. The system of claim 1, wherein:

the veneer mounting plate further includes:

a second support shelf spaced apart from the first support shelf in a second direction; and a second retention clip spaced apart from the first retention clip in the second direction and spaced apart from the second support shelf in the first direction such that the first channel extends between the second support shelf and the second retention clip; and the veneer object is further attached to the veneer mounting plate in the first channel by the second retention clip and the second support shelf, the second retention clip, the first support shelf, and the second support shelf, the veneer object being retained in position on the veneer mounting plate at least in part by the first retention clip, the second retention clip, the first support shelf, and the second support shelf.

3. The system of claim 2, wherein:

the first retention clip is offset from the first support shelf and the second support shelf in the second direction; and the second retention clip is offset from the first support shelf and the second support shelf in the second direction.

4. The system of claim 1, wherein:

the first support shelf is one of a plurality of support shelves of the veneer mounting plate;

the first retention clip is one of a plurality of retention clips of the veneer mounting plate; and the plurality of support shelves and the plurality of retention clips are arranged in a plurality of alternating rows to form a plurality of parallel channels, the first channel being one of the plurality of parallel channels.

5. The system of claim 1, wherein the first retention clip comprises a resilient arm extending outwardly from the first surface of the veneer mounting plate and a stabilizing arm extending downwardly from the resilient arm and configured to contact the first edge of the veneer object to facilitate retaining the veneer object in position.

6. The system of claim 1, wherein:

the veneer object is separated from one or more other veneer objects that also are attached to the veneer mounting plate by respective gaps; and the system further comprises a filler material in the respective gaps.

7. The system of claim 1, wherein the veneer mounting plate includes one or more stiffening ribs.

8. The system of claim 1, further comprising a panel attachment element attached to the second surface of the veneer mounting plate, the veneer mounting plate configured to attach to the support rail via the panel attachment element, the panel attachment element comprising a channel adapted to receive a protrusion of the support rail.

9. The system of claim 1, wherein the veneer object is a thin brick.

10. The system of claim 1, wherein the first support shelf and the first retention clip are integrally formed with the veneer mounting plate.

11. A method comprising:

attaching, to form a preassembled veneer panel, a plurality of veneer objects to a first surface of a veneer mounting plate using respective mechanical attachment mechanisms, each mechanical attachment mechanism including a support shelf and a retention clip cut from the veneer mounting plate, the preassembled veneer panel comprising the veneer mounting plate with the plurality of veneer objects attached to the first surface of the veneer mounting plate using the respective mechanical attachment mechanisms; and attaching, via a first panel attachment element on a second surface of the veneer mounting plate, the preassembled veneer panel to a first support rail coupled to a wall, the second surface of the veneer mounting plate being opposite the first surface and adapted to face the wall when the veneer mounting plate is attached to the wall via the first support rail.

12. The method of claim 11, wherein attaching a particular veneer object of the plurality of veneer objects to the first surface of the veneer mounting plate using a respective mechanical attachment mechanism comprises:

positioning a first edge of the veneer object against the retention clip;

applying a force against a holding force of the retention clip;

rotating the veneer object toward the first surface of the veneer mounting plate such that a second edge of the veneer object engages with the support shelf; and releasing the force applied against the holding force of the retention clip such that the retention clip and the support shelf at least partially retain the veneer object in position on the veneer mounting plate.

13. The method of claim 11, wherein the respective mechanical attachment mechanism for a particular veneer object of the plurality of veneer objects comprises at least two support shelves and at least two retention clips.

14. The method of claim 11, further comprising attaching, prior to attaching the preassembled veneer panel to the first support rail, the first panel attachment element to the second surface of the veneer mounting plate.

15. The method of claim 11, wherein attaching, via the first panel attachment element on the second surface of the veneer mounting plate, the preassembled veneer panel to the first support rail coupled to the wall comprises positioning a protrusion of the first support rail in a channel of the first panel attachment element.

16. The method of claim 11, further comprising attaching, via a second panel attachment element on the second surface of the veneer mounting plate, the preassembled veneer panel to a second support rail coupled to the wall.

17. The method of claim 11, wherein:

gaps are located between adjacent veneer objects of the plurality of veneer objects attached to the veneer mounting plate; and the method further comprises depositing a filler material in the gaps.

18. The method of claim 17, wherein the filler material is deposited in the gaps after attaching the preassembled veneer panel to the support rail coupled to the wall.

19. The method of claim 11, wherein:

the veneer mounting plate comprises a substrate having the first surface and the second surface and a plurality of veneer object attachment strips coupled to the first surface of the substrate; and the method further comprises, prior to attaching, to form the preassembled veneer panel, the plurality of veneer objects to the first surface of the veneer mounting plate using the respective mechanical attachment mechanisms, attaching the plurality of veneer object attachment strips to the substrate the mechanical attachment mechanisms being formed on one or more of the plurality of veneer object attachment strips.

20. A system, comprising:

first and second panel attachment elements configured to attach to a wall via respective support rails attached to the wall; and a veneer mounting plate configured to attach to the wall via the first and second panel attachment elements, the veneer mounting plate including:

a first surface;

a second surface opposite the first surface and adapted to face the wall when the veneer mounting plate is attached to the wall, the first and second panel attachment elements each comprising a respective retaining base for attaching to the second surface of the veneer mounting plate and a respective channel for attaching to the respective support rails;

a plurality of support shelves extending from the first surface, the plurality of support shelves arranged in a plurality of rows each comprising multiple support shelves; and a plurality of retention clips extending from the first surface, the plurality of retention clips arranged in a plurality of rows each comprising multiple retention clips, the plurality of rows of support shelves and the plurality of rows of retention clips being spaced apart and alternating such that respective channels are formed between a row of retention clips and an adjacent row of support shelves, a first retention clip in a first row of retention clips and a first support shelf in the adjacent row of support shelves configured to attach a veneer object to the veneer mounting plate in the channel between the first row of retention clips and the adjacent row of support shelves.

21. The system of claim 20, wherein the veneer object is further attached to the veneer mounting plate in the channel between the first row of retention clips and the adjacent row of support shelves by a second retention clip in the first row of retention clips and a second support shelf in the adjacent row of support shelves.

* * * * *